United States Patent [19]

Ikeda et al.

[11] Patent Number: 4,822,726

[45] Date of Patent: Apr. 18, 1989

[54] METHOD FOR FORMATION OF COLOR IMAGES AND HIGH SILVER CHLORIDE COLOR PHOTOGRAPHIC MATERIALS HAVING IMPROVED SPECTRAL SENSITIVITY AND DESILVERING PROPERTY FOR USE THEREWITH

[75] Inventors: Tadashi Ikeda; Tadashi Ogawa; Masaki Okazaki, all of Kanagawa, Japan

[73] Assignee: Fuji Photo Film Co., Ltd., Kanagawa, Japan

[21] Appl. No.: 59,665

[22] Filed: Jun. 8, 1987

[30] Foreign Application Priority Data

| | | | |
|---|---|---|---|
| Jun. 6, 1986 | [JP] | Japan | 61-131209 |
| Nov. 18, 1986 | [JP] | Japan | 61-274916 |
| Dec. 22, 1986 | [JP] | Japan | 61-306030 |

[51] Int. Cl.[4] ..... G03C 1/12; G03C 1/08; G03C 5/38; G03C 5/44

[52] U.S. Cl. ..... 430/550; 430/393; 430/461; 430/463; 430/505; 430/570; 430/572; 430/574; 430/577; 430/591

[58] Field of Search ..... 430/572, 570, 574, 577, 430/591, 550, 505, 430, 393, 461, 463

[56] References Cited

U.S. PATENT DOCUMENTS

| | | | |
|---|---|---|---|
| 3,814,609 | 6/1974 | Shiba et al. | 430/574 |
| 3,865,598 | 2/1975 | Shiba et al. | 430/575 |
| 4,469,785 | 9/1984 | Tanaka et al. | 430/574 |
| 4,517,284 | 5/1985 | Kagawa et al. | 430/591 |

*Primary Examiner*—Mukund J. Shah

*Attorney, Agent, or Firm*—Sughrue, Mion, Zinn, Macpeak & Seas

[57] ABSTRACT

A method for forming color images and silver halide color photographic material for use therewith are provided by the present invention. The method comprises imagewise exposing a silver halide color photographic material processing with a color developer and then successively processing with a solution having a bleaching ability and having a pH of about 6.5 or less for a period of time of about 75 seconds or less, wherein the silver halide color photographic material contains at least one light-sensitive layer on a support, the light-sensitive layer containing at least one coupler capable of forming a dye by the coupling reaction with the oxidation product of an aromatic primary amine color developing agent and a silver halide emulsion which substantially excludes silver iodide but contains silver chloride in an amount of about 80 mol % or more and which has been spectrally-sensitized with a dye as represented by general formula (I), (II) or (III) described herein. The characteristic aspect of the present invention includes the high spectral sensitivity, the sufficient color forming property and desilvering property almost without the generation of fog, and the possibility of the rapid processing with a color developer which does not substantially contain benzyl alcohol.

33 Claims, No Drawings

METHOD FOR FORMATION OF COLOR IMAGES AND HIGH SILVER CHLORIDE COLOR PHOTOGRAPHIC MATERIALS HAVING IMPROVED SPECTRAL SENSITIVITY AND DESILVERING PROPERTY FOR USE THEREWITH

FIELD OF THE INVENTION

The present invention relates to a method for forming color images, more particularly, color images having a high sensitivity and improved fog-inhibition and desilvering properties, which can rapidly be carried out in a relatively short period of time. Further, the present invention relates to silver halide color photographic materials to be used in the image-forming method.

BACKGROUND OF THE INVENTION

Recently, rapid processing of photographic materials has been keenly desired in the photographic commercial field. Satisfaction of this goal is viewed as extremely important in the industry.

Silver halides essentially comprising silver bromide, which have heretofore been mainly used in photographic materials, are in principle disadvantageous to such rapid photographic processing, since the bromide ion (which is released when the halides themselves are developed) has a development-inhibitory property. Accordingly, the use of silver halides mainly comprising silver chloride are preferred in view of speeding up the photographic processing of silver halide photographic materials.

Specifically, so-called "high silver chloride emulsions" which contain silver chloride in a high content in proportion to other silver halides are advantageous for purposes of rapid processing.

However, the use of such high silver chloride emulsions has been found to result in the following disadvantages when used for the purpose of speeding up photographic processing. More precisely, although a high silver chloride emulsion can rapidly be fixed in the desilvering step, the developed silver formed therefrom after having been developed is hardly bleached at all as compared with the developed silver formed when using a low silver chloride emulsion. This results in a disadvantage when attempting to shorten development processing which includes the desilvering step. Further, if such difficult bleachability is sought to be overcome by prolonging the desilvering time, the prolonged time will counterbalance the shortened period in the development step or, as the case may be, the prolonged time will be longer than the shortened period therein. In the desilvering step, a bleach bath and a fix bath are used in combination, or alternatively, a blix (bleach-fix) bath is used. In general, the bleaching agent to be used in the blix bath is an organic iron-chelating agent such as an aminopolycarboxylic acid/iron salt, which has the requisite oxidizing ability when used together with the fixing agent of a silver halide solvent. However, when a blix bath without strong oxidizing ability is used or, in particular, when the processing solution has been fatigued after a large amount of silver halide photographic materials have been processed therein or when the amount of the processing solution having been carried over into the bath from the previous bath has increased, the oxidizing ability of the blix bath will remarkably deteriorate, which results in a noticeable retardation of the bleaching of the developed silver. In this situation, it is often noted in some extreme cases that some parts of the developed silver from the high silver chloride emulsion still remain in their original state, almost without being desilvered at all, even after very extensive bleaching time.

In addition, shortening of the exposure time is important for the simplification of the total photographic processing procedure in order to improve overall laboratory productivity, and the emulsions to be used are required to be highly sensitive. However, it is known that high silver chloride emulsions also suffer from the disadvantages that they are easily fogged and are poor in sensitivity, although the development of such emulsions can proceed rapidly.

Silver halides generally have an intrinsic absorption range in a short wavelength range, and thus are generally spectrally sensitized so that they can absorb and be sensitive to visible rays and/or infrared rays having longer wavelengths.

However, the spectral sensitivity of a high silver chloride emulsion comprising silver chloride in an amount of 80 mol% or more is usually extremely poor even if the emulsion is spectrally sensitized with a compound which is generally applied to an emulsion essentially comprising silver bromide. In particular, this effect is even more remarkable in a high silver chloride emulsion having silver chloride in an amount of 95 mol% or more.

Moreover, it has been found that most of the spectral sensitizers described in Japanese Patent Application (OPI) Nos. 106538/83, 107531/83, 107532/83, 107533/83, 9144/83 and 95339/83 (the term "OPI" as used herein refers to a "published unexamined Japanese patent application"), or spectral sensitizers which have generally been used for silver halides essentially comprising silver bromide, would largely inhibit bleaching of the developed silver formed from a high silver chloride emulsion.

In general, the extent of bleaching of developed silver depends not only upon the oxidizing ability of the bleaching solution, but also upon the shape or form of the developed silver, as well as the amount of the developed silver. This lesser extent of bleaching of the developed silver from a high chloride emulsion as compared to the extent of bleaching of the developed silver from a low silver chloride emulsion was determined by electron microscopic observation of the developed silver, and theorized to result from the difference of the shapes of the developed silvers therebetween.

In this connection, the more important fact is that the bleaching of the developed silver would be retarded or inhibited by any compound having been adsorbed onto the surface of the developed silver, and the extent of bleaching would also depend upon the kind of compound adsorbed. In general, most silver halide color photographic materials are constituted so as to be able to attain various functions in the respective processing steps from light-exposure to development and coloration; therefore, a variety of compounds are incorporated in the photographic materials in order to attain these respective functions. Accordingly, it is important that the photographic materials can satisfy these necessary requirements without accompanying desilvering inhibition as mentioned above.

The desilvering inhibition of the developed silver as formed from a high silver chloride emulsion was additionally observed to be caused by the presence of bromide ions, which are generally added to a color developer solution so as to maintain uniformity of development. In this case, it is assumed that bromide ions would cause the variation in the shape or form of the developed silver.

In order to solve these problems, the present inventors have conducted various studies, and as a result have determined that dyes represented by general formula (I), (II) or (III) described below can display a high spectral sensitizing ability to high silver chloride emulsions.

In particular, among these compounds cyanine dyes display a so-called J-band type spectral sensitizing ability, even in a high silver chloride emulsion containing silver chloride in an amount of 95 mol% or more, and thus, these dyes not only an an excellent J-association formability, but also an excellent adsorbability to high silver chloride grains. Further, such cyanine dyes have a high spectral sensitizing ability.

However, these dyes also show a strong adsorption to developed silver formed from a high silver chloride emulsion and thus, desilvering inhibition is observed in a general bleaching process using these cyanine dyes.

SUMMARY OF THE INVENTION

Accordingly, one object of the present invention is to provide color photographic light-sensitive materials which contain a high silver chloride emulsion having a high spectral sensitivity.

Another object of the present invention is to provide a method for forming color images comprising bleaching the developed silver which is formed by color-developing the light-sensitive materials.

More specifically, one object of the present invention is to provide a method for forming color images comprising imagewise exposing a silver halide color photographic material followed by processing with a color developer and then successively processing with a solution having a bleaching ability and having a pH of about 6.5 or less for a period of time of about 75 seconds or less wherein the silver halide color photographic material comprises at least one light-sensitive layer on a support, the light-sensitive layer containing at least one coupler capable of forming a dye by the coupling reaction with the oxidation product of an aromatic primary amine color developing agent and containing a silver halide emulsion which substantially excludes silver iodide but contains silver chloride in an amount of about 80 mol% or more and which has been spectrally sensitized with a sensitizing dye represented by general formula (I), (II) or (III):

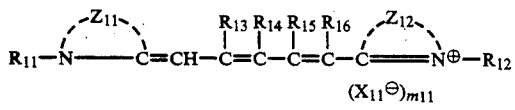

(I)

wherein $Z_{11}$ represents an atomic group necessary to form a benzoxazole nucleus, a naphthoxazole nucleus, a benzothiazole nucleus, a naphthothiazole nucleus, a dihydronaphthothiazole nucleus, a benzoselenazole nucleus, a naphthoselenazole nucleus or a dihydronaphthoselenazole nucleus;

$Z_{12}$ represents an atomic group necessary to form a benzothiazole nucleus, a naphthothiazole nucleus, a dihydronaphthothiazole nucleus, a benzoselenazole nucleus, a naphthoselenazole nucleus or a dihydronaphthoselenazole nucleus;

the nitrogen-containing heterocyclic nuclei represented by $Z_{11}$ and $Z_{12}$ may optionally have one or more substituents;

$R_{11}$ and $R_{12}$ may be the same or different and each represents an alkyl group or an alkenyl group having 10 or less carbon atoms and which may optionally be substituted;

$R_{13}$ and $R_{15}$ both are hydrogen atoms, or $R_{13}$ and $R_{15}$ may be linked together to form a 5- or 6-membered ring;

$R_{14}$ represents a hydrogen atom, when $R_{13}$ is linked with $R_{15}$ to form a 5- or 6-membered ring; or when $R_{13}$ and $R_{15}$ both are hydrogen atom, $R_{14}$ represents an alkyl group having 4 or less carbon atoms or a phenylalkyl group having 10 or less carbon atoms;

$R_{16}$ represents a hydrogen atom, or may be linked with $R_{12}$ to form a 5- or 6-membered carbon-ring;

$X_{11}^{\ominus}$ represents an acid anion residue;

$m_{11}$ represents 0 or 1; and when the sensitizing dye represented by formula (I) forms an internal salt, $m_{11}$ is 0;

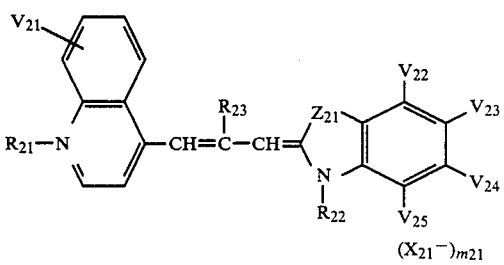

(II)

wherein $Z_{21}$ represents a sulfur atom or a selenium atom;

$R_{21}$ and $R_{22}$ each has the same definition as $R_{11}$ or $R_{12}$ in formula (I), with the proviso that at least one of $R_{21}$ and $R_{22}$ must be a substituent containing a sulfo group or a carboxyl group;

$R_{23}$ represents a hydrogen atom or a lower alkyl group having 4 or less carbon atoms;

$V_{21}$ represents a hydrogen atom, an alkyl group or an alkoxy group having 6 or less carbon atoms, a fluorine atom, a chlorine atom or a hydroxyl group;

$V_{22}$ and $V_{25}$ each represents a hydrogen atom;

$V_{23}$ represents a hydrogen atom, a lower alkyl group, a lower alkoxy group or a hydroxyl group;

$V_{24}$ represents a hydrogen atom, a lower alkyl group, a lower alkoxy group, a chlorine atom, a lower alkoxycarbonyl group, an optionally substituted phenyl group or a hydroxyl group;

$V_{22}$ and $V_{23}$, $V_{23}$ and $V_{24}$, and $V_{24}$ and $V_{25}$ each may optionally be linked together to form a condensed benzene ring, which can further be substituted;

$X_{21}^{-}$ represents an acid anion residue;

$m_{21}$ represents 0 or 1; and when the sensitizing dye represented by formula (II) forms an internal salt, $m_{21}$ is 0;

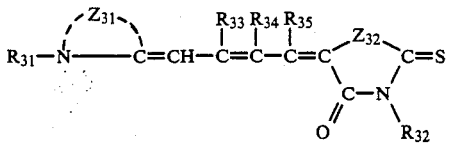

(III)

wherein $Z_{31}$ has the same definition as $Z_{12}$ in formula (I), or represents an atomic group capable of forming a naphthoxazole nucleus, and the nitrogen-containing heterocyclic nuclei represented by $Z_{31}$ can have one or more substituents;

$Z_{32}$ represents a sulfur atom, a selenium atom or

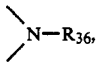

wherein $R_{36}$ represents a hydrogen atom, a pyridyl group, a phenyl group, a substituted phenyl group or an aliphatic hydrocarbon group which may optionally contain an oxygen atom, a sulfur atom or a nitrogen atom in the carbon chain and which may optionally be substituted, the total number of carbon atoms in the aliphatic hydrocarbon group being 8 or less;

$R_{31}$ has the same definition as $R_{11}$ or $R_{12}$ in formula (I);

$R_{32}$ has the same definition as $R_{11}$ or $R_{12}$ in formula (I), or represents a hydrogen atom, a furfuryl group or an optionally substituted mono-cyclic aryl group;

$R_{33}$ and $R_{35}$ each represents a hydrogen atom, or $R_{33}$ and $R_{35}$ may be linked together to form a 5- or 6-membered ring;

$R_{34}$ has the same definition as $R_{14}$ in formula (I);

with the proviso that at least one of $R_{31}$ and $R_{32}$ does not contain a sulfo group and the other is a group containing a sulfo group or a carboxyl group.

Another embodiment of the present invention provides a silver halide color photographic material having at least one light-sensitive layer on a support, the light-sensitive layer containing at least one coupler capable of forming a dye by the coupling reaction with the oxidation product of an aromatic primary amine color developing agent and containing a silver halide emulsion which substantially excludes silver iodide but contains silver chloride in an amount of about 80 mol% or more and which had been spectrally sensitized with a sensitizing dye represented by the above-mentioned general formula (I), (II) or (III).

The above and other object of the present invention will become more apparent in light of the following detailed description of the invention.

DETAILED DESCRIPTION OF THE INVENTION

The present invention relates to a method for forming color images comprising imagewise exposing a silver halide color photographic material followed by subjecting the photographic material to color development and then successively processing the photographic material with a solution having a bleaching ability and having a pH of about 6.5 or less (that is, a bleach-fix or blix solution or a bleach solution) for a period of time of about 75 seconds or less, wherein the photographic material comprises at least one light-sensitive layer on a support, the light-sensitive layer containing at least one coupler capable of forming a dye by the coupling reaction with the oxidation product of an aromatic primary amine color developing agent and containing a silver halide emulsion which substantially excludes silver iodide but contains silver chloride in an amount of about 80 mol% or more, preferably 90 mol% or more, most preferably 95 mol% or more, and at least one high silver chloride-containing light-sensitive layer contains at least one dye selected from the compounds represented by general formula (I), (II) or (III):

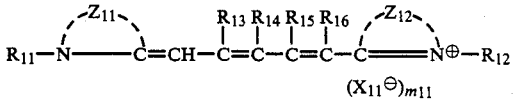

(I)

wherein $Z_{11}$ represents an atomic group necessary to form a benzoxazole nucleus, a naphthoxazole nucleus, a benzothiazole nucleus, a naphthothiazole nucleus, a dihydronaphthothiazole nucleus, a benzoselenazole nucleus, a naphthoselenazole nucleus, a dihydronaphthoselenazole nucleus;

$Z_{12}$ represents an atomic group necessary to form a benzothiazole nucleus, a naphthothiazole nucleus, a dihydronaphthothiazole nucleus, a benzoselenazole nucleus, a naphthoselenazole nucleus or a dihydronaphthoselenazole nucleus;

with the proviso that the nitrogen-containing heterocyclic nuclei repesented by $Z_{11}$ and $Z_{12}$ may optionally have one or more substituents.

Preferred examples of the substituents on $Z_{11}$ and $Z_{12}$ include a lower alkyl group (more preferably an alkyl group having 6 or less carbon atoms), a lower alkoxy group (more preferably an alkoxy group having 6 or less carbon atoms), a chlorine atom, a lower alkoxycarbonyl group (more preferably an alkoxycarbonyl group having 5 or less carbon atoms), an optionally substituted phenyl group (e.g., a phenyl group, a tolyl group, an anisyl group, an chlorophenyl group, etc.) or a hydroxyl group.

Typical examples of the nitrogen-containing heterocyclic groups represented by $Z_{11}$ and $Z_{12}$ are, for example, a 5-hydroxybenzoxazole group, a 5-methoxybenzoxazole group, a ethoxybenzoxazole group, a 5-phenylbenzoxazole group, a 5,6-dimethylbenzoxazole group, a 5-methyl-6-methoxybenzoxazole group, a 6-ethoxy-5-hydrobenzoxazole group, a naphtho[1,2-d]oxazole group, a naphtho[2,3-d]oxazole group, a naphtho[2,1-d]oxazole group, a 5-methyl benzothiazole group, a 5-methoxybenzothiazole group, a 5-ethylbenzothiazole group, a 5-p-tolylbenzothiazole group, a 6-methyl benzothiazole group, a 6-ethylbenzothiazole group, a 6-butylbenzothiazole group, a 6-methoxybenzothiazole group, a 6-butoxybenzothiazole group, a 5,6-dimethylbenzothiazole group, a 5,6-dimethoxybenzothiazole group, a 5-hydroxy-6-methyl benzothiazole group, a 5-ethoxycarbonylbenzothiazole group, a 5-chlorobenzothiazole group, 5-5-chloro-6-methylbenzothiazole group, a naphtho[1,2-d]thiazole group, a naphtho[2,1-d]thiazole group, a 5-methylnaphtho[2,1-d]thiazole group, an 8,9-dihydronaphtho[1,2-d]thiazole group, an 8-methoxynaphtho[1,2-d]thiazole group, a benzothiazole group, a benzoselenazole group, a 5-methoxybenzoselenazole group, a 6-methylbenzoselenazole group, a 5-methoxybenzoselenazole group, a 6-methoxybenzoselenazole group, a 5,6-dimethylbenzoselenazole group, a 5-ethoxy-6-methylbenzoselenazole group, a 5-hydroxy-6-methylbenzoselenazole group, a naphtho[1,2-d]selenazole group, a naphtho[2,1-d]selenazole group, etc.

$R_{11}$ and $R_{12}$ in formula (I) may be the same or different, and each represents an alkyl group or alkenyl group which has 10 or less carbon atoms and which can optionally be substituted. Suitable substituents on the alkyl or alkenyl group include, for example, a sulfo group and an alkoxy group having 6 or less carbon atoms, a halogen atom, a hydroxyl group, an optionally substituted aryl group having 8 or less carbon atoms (e.g., a phenyl group, a furyl group, a thienyl group, a tolyl group, a p-butylphenyl group, a xylyl group, an anisyl group, a sulfophenyl group, a hydroxyphenyl group, a carboxyphenyl group, a chlorophenyl group, etc.), a phenoxy group which has 8 or less carbon atoms and which may optionally be substituted (for example, by one or more substituents selected from a fluorine atom, a chlorine atom, a sulfo group, a hydroxyl group, a carboxyl group, an alkoxycarbonyl group, an alkyl group, an alkoxy group, etc.), an acyl group having 8 or less carbon atoms (e.g., a phenylsulfonyl group, a tosyl group, a methylsulfonyl group, a benzoyl group, an acetyl group, a propionyl group, etc.), an alkoxycarbonyl group having 6 or less carbon atoms, a carboxyl group, etc.

$R_{13}$ and $R_{15}$ in formula (I) each represents a hydrogen atom. Alternatively, $R_{13}$ may be linked with $R_{15}$ to form a 5- or 6-membered ring. When $R_{13}$ is linked with $R_{15}$ to form a 5- or 6-membered ring, $R_{14}$ represents a hydrogen atom. Alternatively, when $R_{13}$ and $R_{15}$ both are hydrogen atom, $R_{14}$ represents an alkyl group having 4 or less carbon atoms or a phenylalkyl group having 10 or less carbon atoms.

More preferably, $R_{14}$ represents a hydrogen atom, $R_{13}$ is linked with $R_{15}$ to form a 5- or 6-membered ring; or $R_{13}$ and $R_{15}$ both are hydrogen atoms, and $R_{14}$ represents an alkyl group having 4 or less carbon atoms or a benzyl group.

$R_{16}$ represents a hydrogen atom or may be linked with $R_{12}$ to form a 5- or 6-membered carbon ring.

Among the nitrogen-containing heterocyclic nucleus-forming atomic groups represented by $Z_{11}$, more preferred heterocyclic nuclei are napthoxazoles, benzothiazoles having at least one electron-donating group with a negative Hammett's $\sigma p$ value, dihydronaphthothiazoles, naphthothiazoles and benzoselenazoles.

$X_{11}^{\ominus}$ in formula (I) represents an acid anion residue; and $m_{11}$ represents 0 or 1, and when the compound of formula (I) is an internal salt, $m_{11}$ is 0.

General formula (II) is as follows:

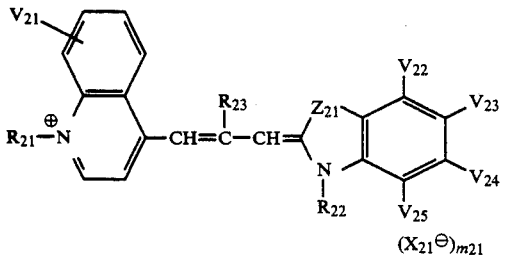

(II)

wherein $Z_{21}$ represents a sulfur atom or a selenium atom;

$R_{21}$ and $R_{22}$ have the same definition as $R_{11}$ or $R_{12}$ in formula (I); with the proviso that at least one of them must contain a sulfo group or a carboxyl group;

$R_{23}$ represents a hydrogen atom or a lower alkyl group having 4 or less carbon atoms;

$V_{21}$ represents a hydrogen atom, an alkyl group having 6 or less carbon atoms, an alkoxy group having 6 or less carbon atoms, a fluorine atom or a hydroxyl group;

$V_{22}$ and $V_{25}$ each represents a hydrogen atom;

$V_{23}$ represents a hydrogen atom, a lower alkyl group (preferably an alkyl group having 6 or less carbon atoms), a lower alkoxy group (preferably an alkoxy group having 6 or less carbon atoms) or a hydroxyl group;

$V_{24}$ represents a hydrogen atom, a lower alkyl group (preferably an alkyl group having 6 or less carbon atoms), a lower alkoxy group (preferably an alkoxy group having 6 or less carbon atoms), a chlorine atom, a lower alkoxycarbonyl group, an optionally substituted phenyl group (e.g., a phenyl group, a tolyl group, an anisyl group, etc.) or a hydroxyl group;

$V_{22}$ and $V_{23}$, $V_{23}$ and $V_{24}$, and $V_{24}$ and $V_{25}$ may be linked together to form a condensed benzene ring, which may be optionally substituted. Examples of suitable substituents on the condensed benzene ring include a chlorine atom, a lower alkyl group (preferably having 4 or less carbon atoms), a lower alkoxy group (preferably having 4 or less carbon atoms), etc.

The most preferred of the nitrogen-containing heterocyclic nuclei which contain $Z_{21}$, are a naphtho[1,2d]-thiazole nucleus, a naphtho[2,1-d]thiazole nucleus, a naphtho[1,2-d]selenazole nucleus, a naphtho[2,1-d]selenazole nucleus or benzoselenazole nuclei having at least one electron-donating group with a negative Hammett's $\sigma p$ value.

In formula (II), $X_{21}^{\oplus}$ represents an acid anion residue, whereas $m_{21}$ represents 0 or 1 with the proviso that when the compound of formula (II) forms an internal salt, $m_{21}$ is 0.

General formula (III) is described hereinbelow:

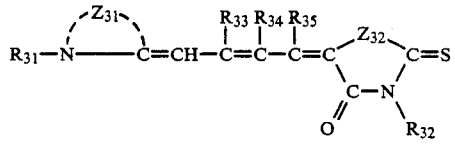

(III)

wherein $Z_{31}$ has the same definition as $Z_{12}$ in formula (I) or $Z_{31}$ represents an atomic group capable of forming a naphthoxazole nucleus, and may optionally have one or more substituents selected from substituents referred to above for the nitrogen-containing heterocyclic nuclei represented by $Z_{11}$ or $Z_{12}$ in formula (I);

$Z_{32}$ represents a sulfur atom, a selenium atom or

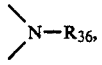

wherein $R_{36}$ represents a hydrogen atom, a pyridyl group, a phenyl group, a substituted phenyl group (e.g., a tolyl group, an anisyl group, a hydroxyphenyl group, etc.) or an aliphatic hydrocarbon residue which may contain an oxygen atom, a sulfur atom or a nitrogen atom in the carbon chain and which may be substituted by one or more substituents selected from a hydroxyl group, a halogen atom, an alkylaminocarbonyl group, an alkoxycarbonyl group and a phenyl group, the total number of carbon atoms in the aliphatic hydrocarbon residue being 8 or less; more preferably $R_{36}$ represents a hydrogen atom, a phenyl group, a pyridyl group or an alkyl group which may contain an oxygen atom in the carbon chain and which may have a hydroxyl group;

$R_{31}$ has the same meaning as $R_{11}$ or $R_{12}$ in formula (I);

$R_{32}$ has the same meaning as $R_{11}$ or $R_{12}$ in formula (I) or $R_{32}$ represents a hydrogen atom, a furfuryl group or an optionally substituted mono-cyclic aryl group (e.g., a phenyl group, a tolyl group, an anisyl group, a carboxyphenyl group, a hydroxyphenyl group, a chlorophenyl group, a sulfophenyl group, a pyridyl group, a 5-methyl-2-pyridyl group, a 5-chloro-2-pyridyl group, a furyl group or a thienyl group);

$R_{33}$ and $R_{35}$ each represents a hydrogen atom, or $R_{33}$ and $R_{35}$ may be linked together to form a 5- or 6-membered ring; $R_{34}$ has the same meaning as $R_{14}$ in formula (I);

with the proviso that at least one of $R_{31}$ and $R_{34}$ does not contain a sulfo group and the other is a group containing a sulfo group or a carboxyl group.

The present invention, described in further detail below, thus provides a silver halide color photographic material which contains a high silver chloride emulsion and which has been spectrally sensitized by a spectral sensitizing dye represented by the above-mentioned general formula (I), (II) or (III), wherein the photographic material is able to be subjected to color-development with a color developer which substantially excludes benzyl alcohol and which contains bromide ion in an amount of about 0.002 mol/liter or less for a short period of time of about 2 minutes and 30 seconds or less and then is successively processed with a blix solution having pH of about 6.5 or less, more preferably a pH of 6.0 or less, for a period of time of about 75 seconds or less, even possibly for a shorter period of time of 60 seconds or less, resulting in the formation of color images.

Typical examples of the compounds of the general formula (I), (II) and (III) are set forth below in order to illustrate the present invention in more detail; however, these examples should not be construed as limiting the scope of the present invention in any manner.

I-1

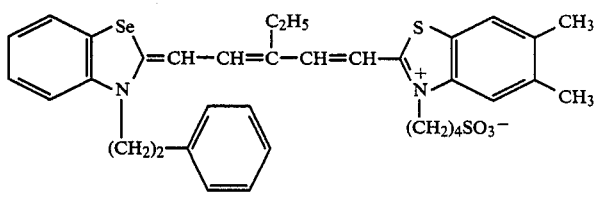

I-2

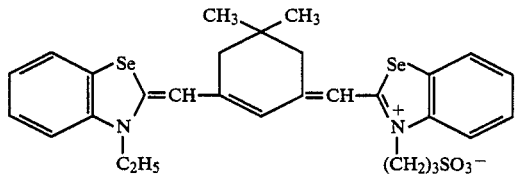

I-3

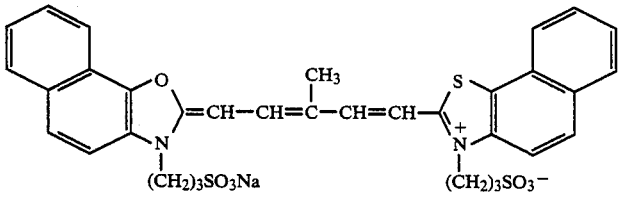

I-4

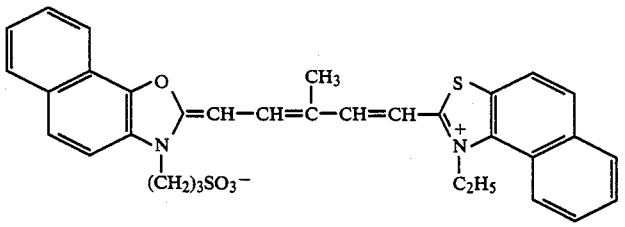

-continued
I-5
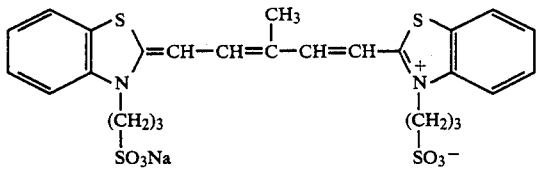
I-6
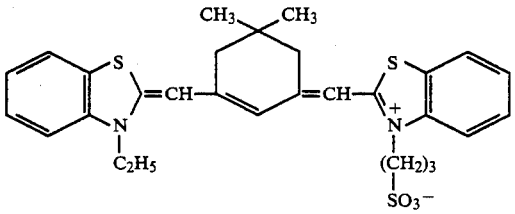
I-7
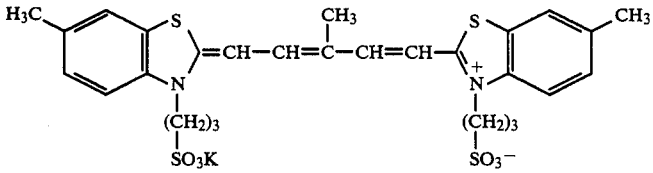
I-8
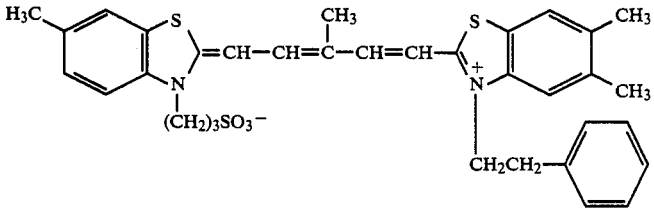
I-9
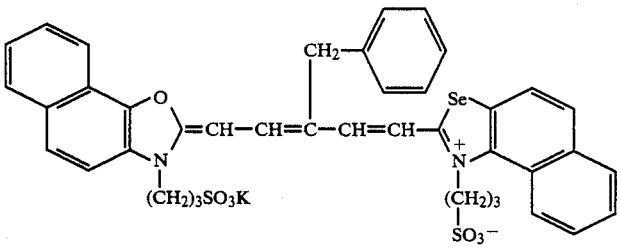
I-10
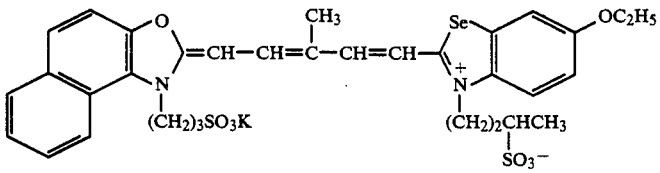
I-11
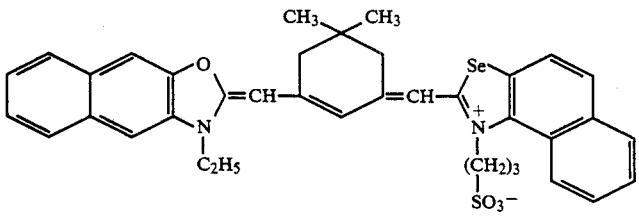

-continued
I-12
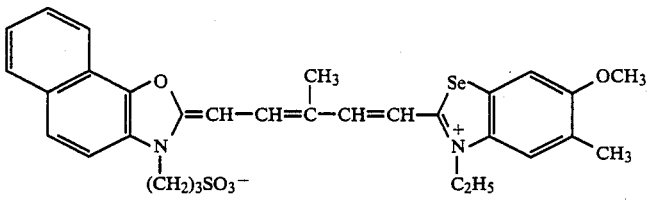
I-13
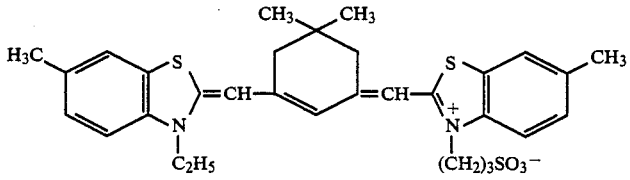
I-14
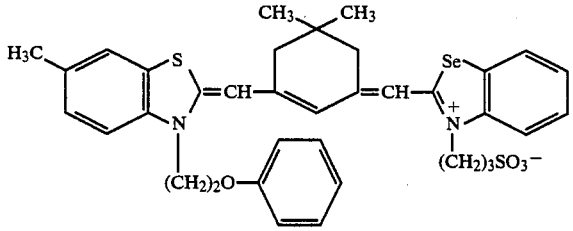
I-15
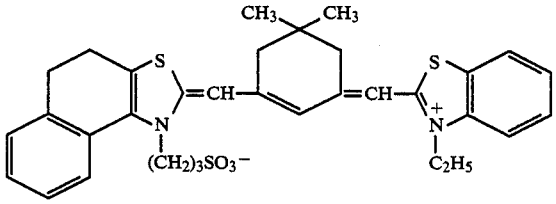
I-16
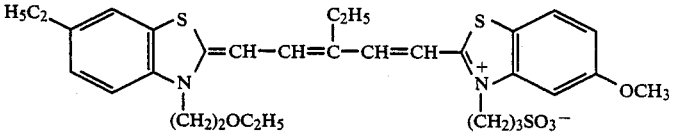
I-17
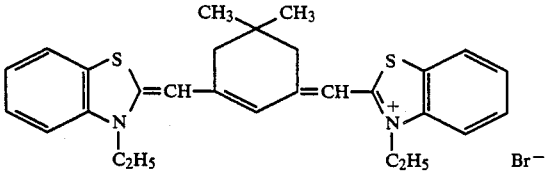
I-18
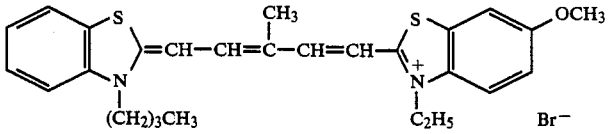
I-19
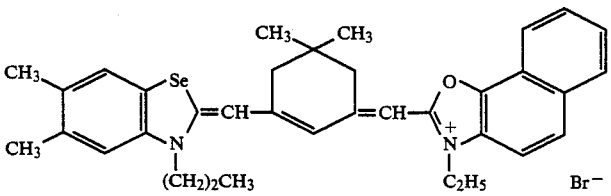

-continued
I-20
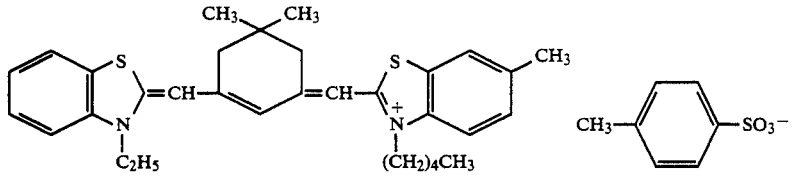
II-1
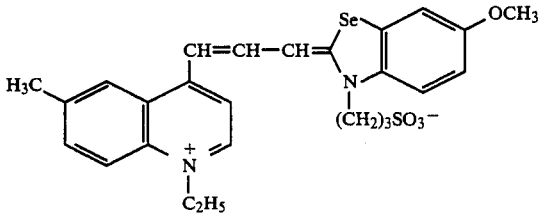
II-2
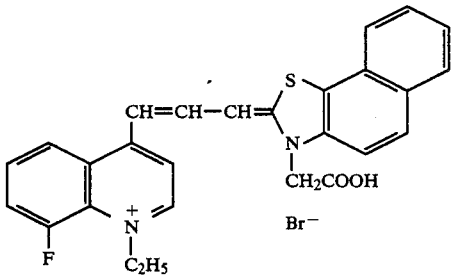
II-3
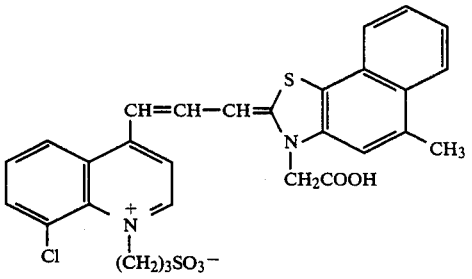
II-4
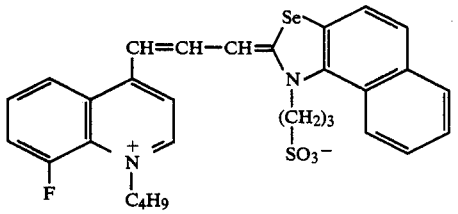
II-5
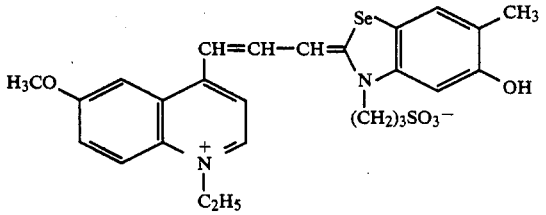

-continued
III-1
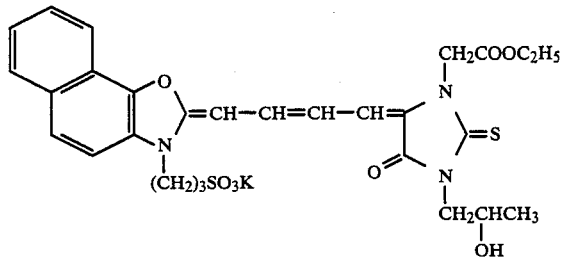
III-2
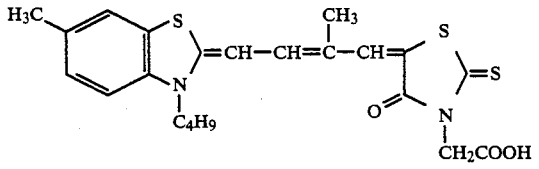
III-3
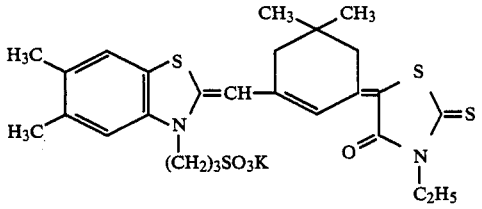
III-4
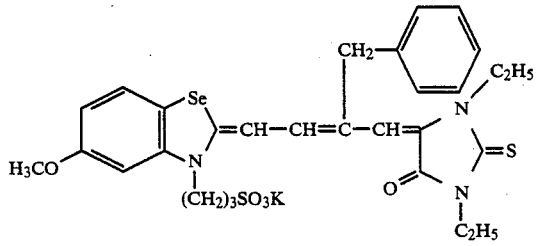
III-5
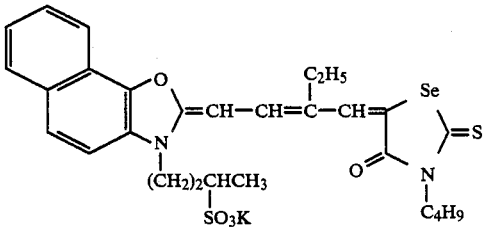
III-6
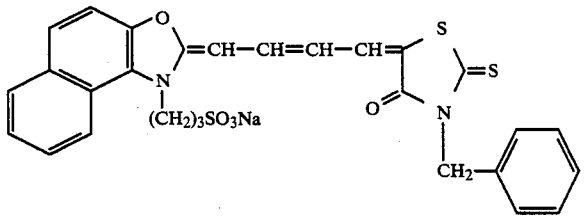

-continued
III-7
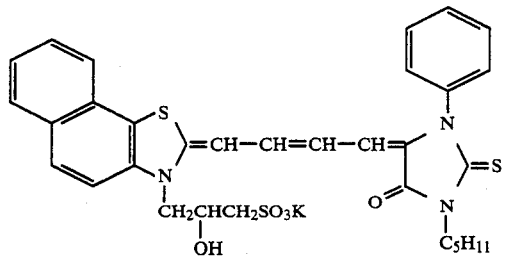
III-8
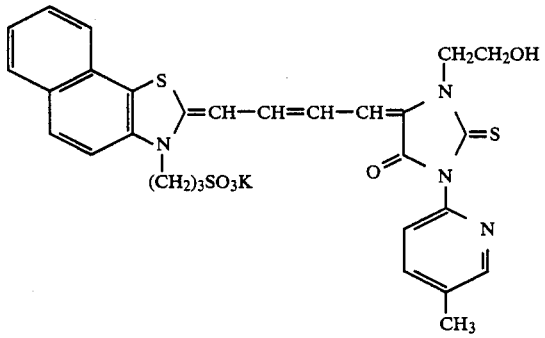
III-9
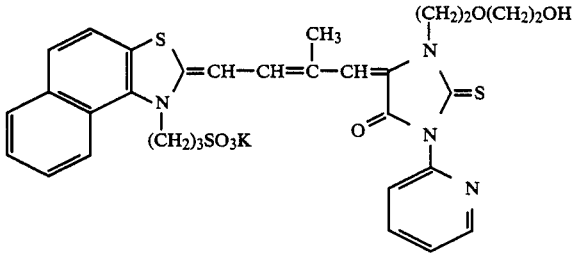
III-10
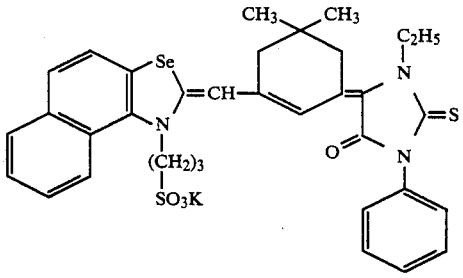
III-11
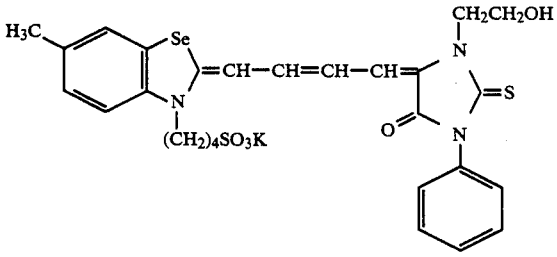
III-12
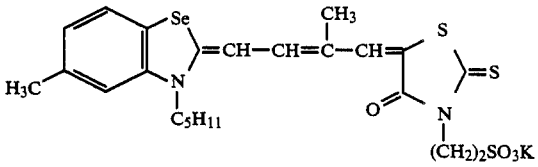

-continued

III-13

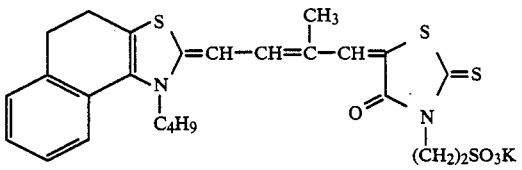

III-14

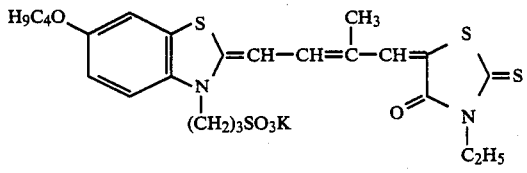

III-15

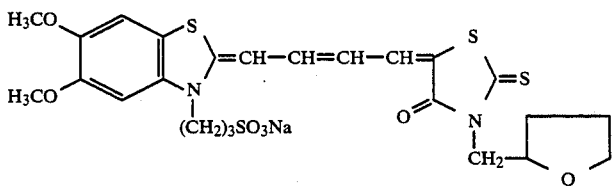

III-16

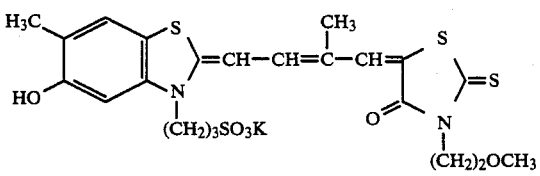

Spectral sensitization with the dye represented by the above-mentioned formula (I), (II) or (III) can be remarkably elevated by the incorporation into the light-sensitive layer of a compound of general formula (IV) described below together with the sensitizing dye:

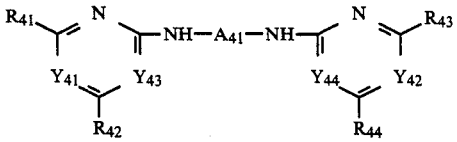

(IV)

wherein $Y_{41}$, $Y_{42}$, $Y_{43}$ and $Y_{44}$ may be the same or different, and each represents =CH— or =N—, with proviso that at least one of Y41 and $Y_{43}$ and at least one of $Y_{42}$ and $Y_{44}$ represent =N—;

$R_{41}$, $R_{42}$, $R_{43}$ and $R_{44}$ may be the same or different, and each represents a hydrogen atom, a hydroxyl group, a lower alkoxy group (preferably having 10 or less carbon atoms), an aryloxy group (e.g., a phenoxy group, a tolyloxy group, a sulfophenoxy group, a β-napthoxy group, an α-naphthoxy group, a 2,4-dimethylphenoxy group, etc.), a halogen atom (e.g., a chlorine atom, a bromine atom, etc.), a heterocyclic group (e.g., a morpholinyl group, a piperidine group, etc.), an alkylthio group (e.g., a methylthio group, an ethylthio group, etc.), a heterocyclicthio group (e.g., a benzothiazolylthio group, etc.), an arylthio group (e.g., a phenylthio group, a tolylthio group, etc.), an amino group, an alkylamino or substituted alkylamino group (e.g., a methylamino group, an ethylamino group, a propylamino group, a dimethylamino group, a diethylamino group, a dodecylamino group, a cyclohexylamino group, a β-hydroxyethylamino group, a di-β-hydroxyethylamino group, a β-sulfoethylamino group, etc.), an arylamino or substituted arylamino group (e.g., an anilino group, an o-sulfoanilino group, an m-sulfoanilino group, a p-sulfoanilino group, an o-anisylamino group, an m-anisylamino group, a p-anisylamino group, an o-methylanilino group, a p-t-amylanilino group, an o-carboxyanilino group, an m-carboxyanilino group, a p-carboxyanilino group, a hydroxyanilino group, a naphthylamino group, a sulfonaphthylamino group, etc.), a heterocyclic-amino group (e.g., a 2-benzothiazolamino group, a 2-pyridylamino group, etc.), an aryl group (e.g., a phenyl group, etc.) or a mercapto group; $A_{41}$ represents a group comprising at least one arylene group, which includes, for example, the following groups:

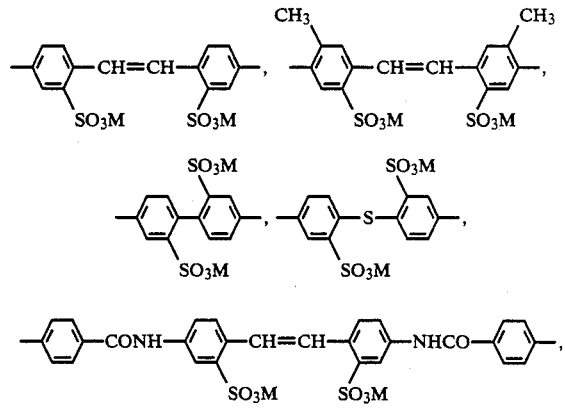

-continued

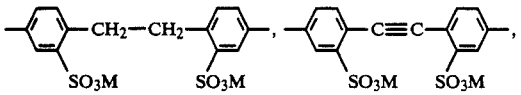

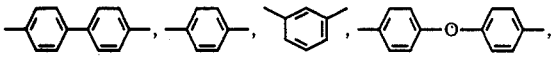

-continued

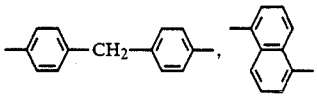

In the above-mentioned groups containing at least one arylene group, M represents a hydrogen atom or a cation for imparting water-solubility to the compound.

In the compounds represented by formula (IV), at least one of $R_{41}$, $R_{42}$, $R_{43}$, $R_{44}$ and $A_{41}$ must be a sulfo-containing group.

The most preferred compounds among the compounds represented by formula (IV) are stilbene derivatives.

Specific examples of compounds represented by formula (IV) are illustrated below, but such should not be construed as limiting the present invention in any manner.

IV-1
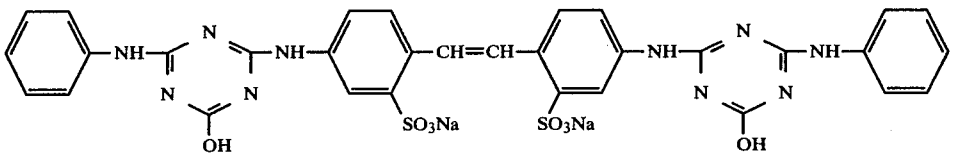
IV-2
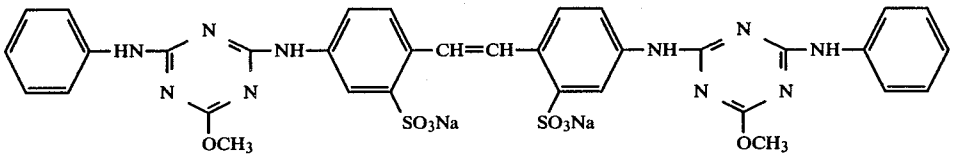
IV-3
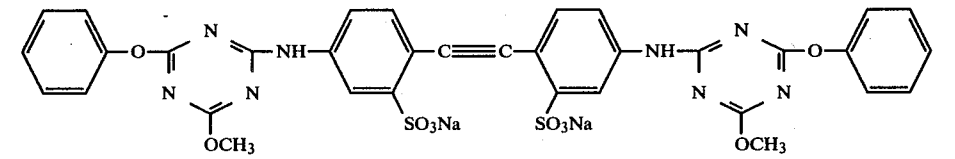
IV-4
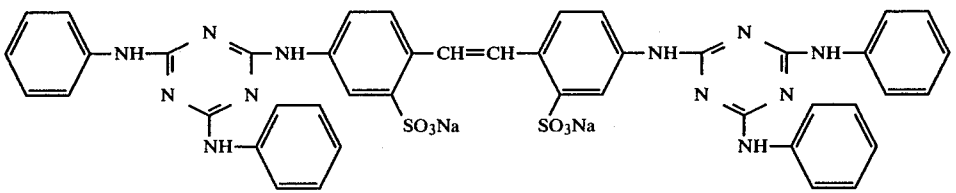
IV-5
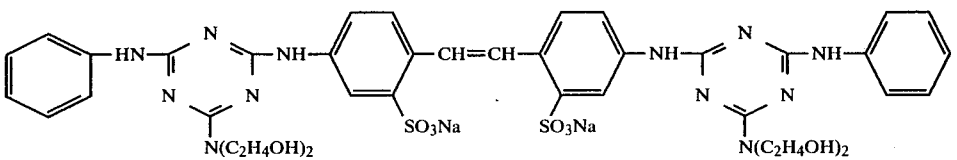

-continued
IV-6
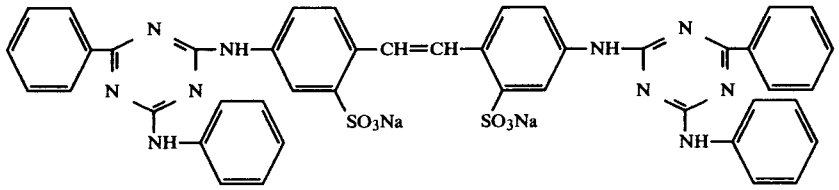
IV-7
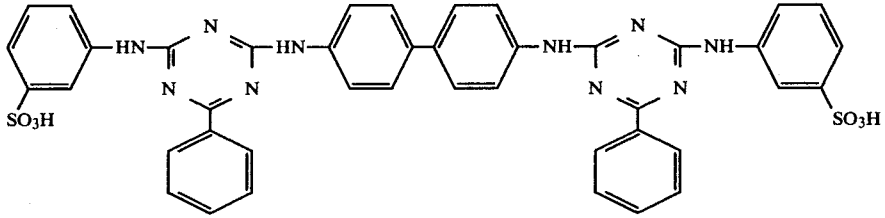
IV-8
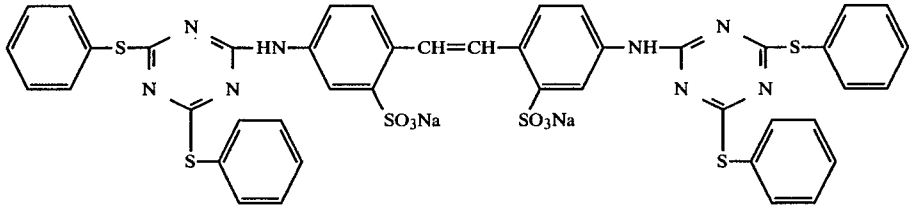
IV-9
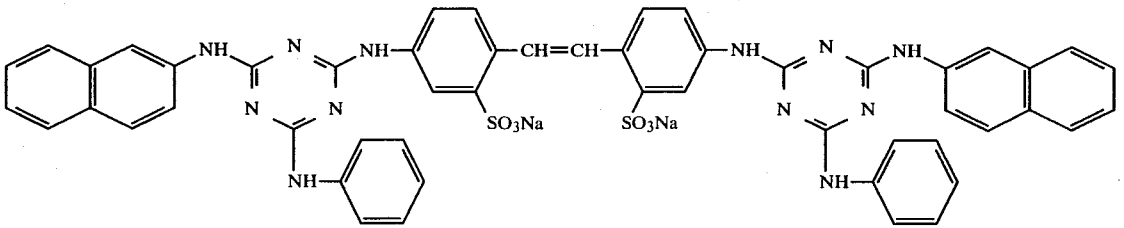

-continued
IV-10
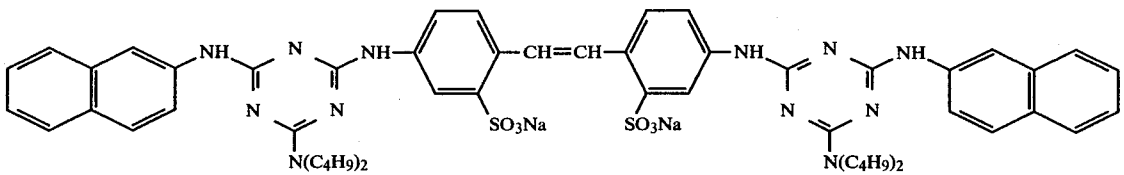
IV-11
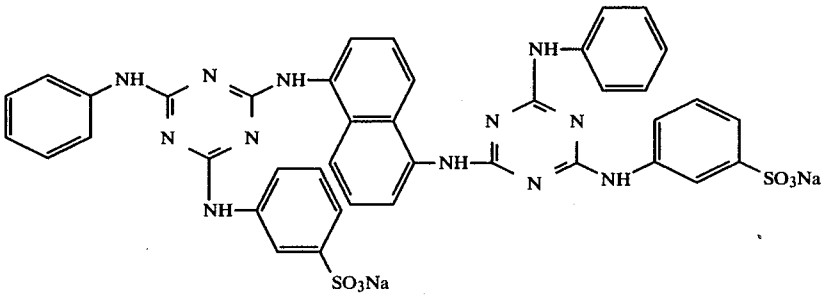
IV-12
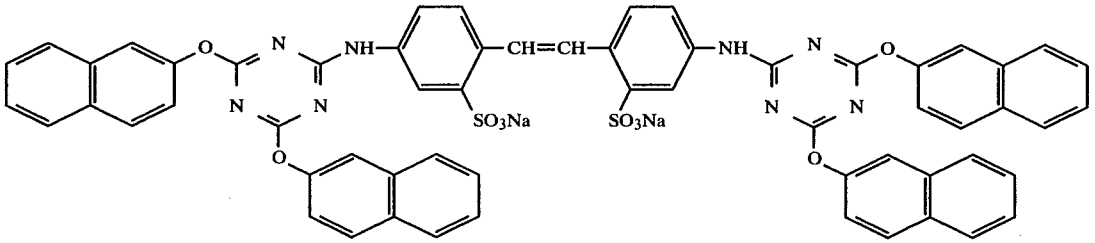
IV-13
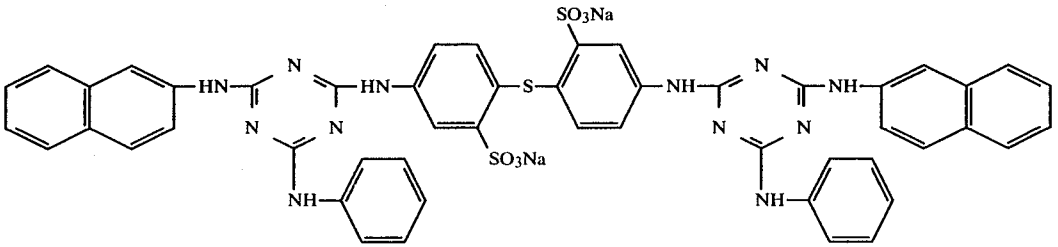

-continued
IV-14
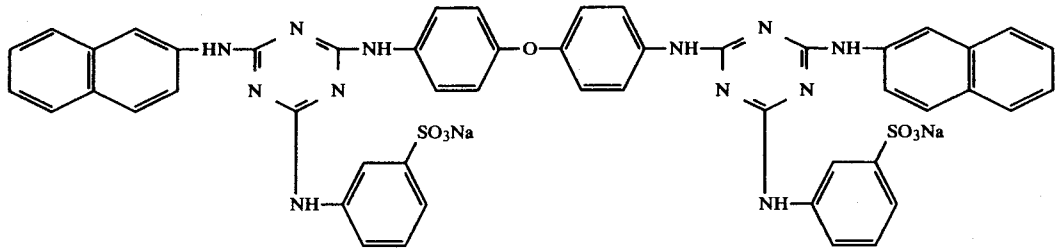
IV-15
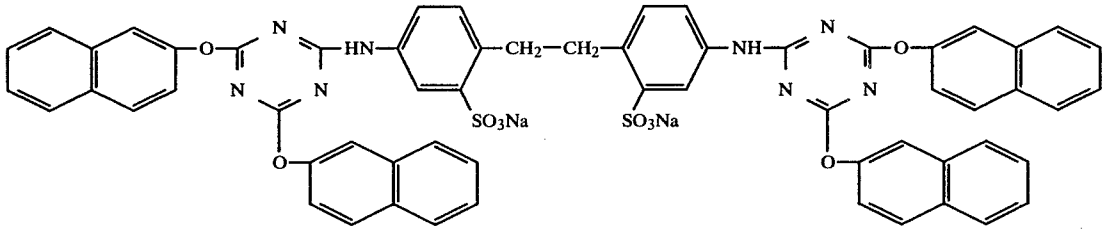
IV-16
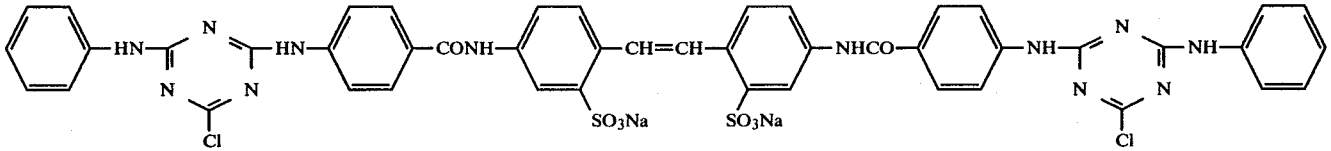
IV-17
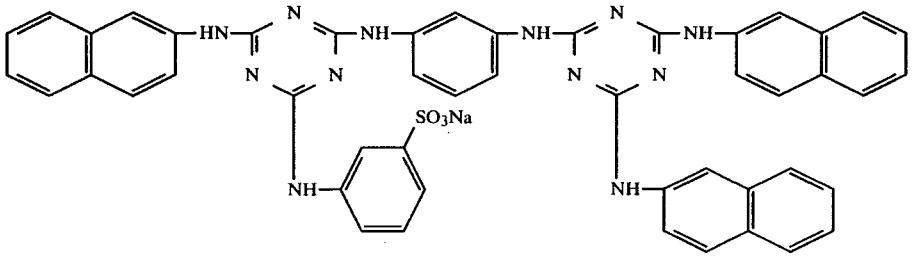

-continued
IV-18
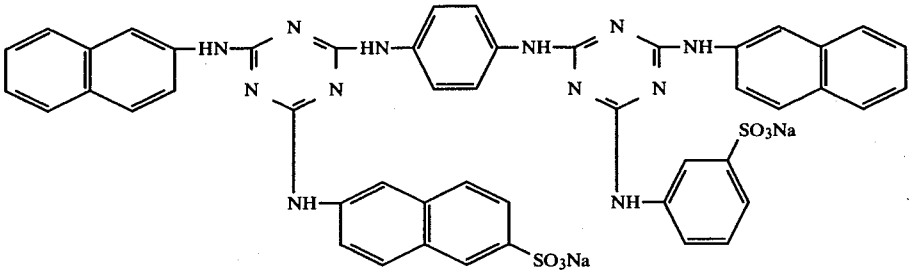
IV-19
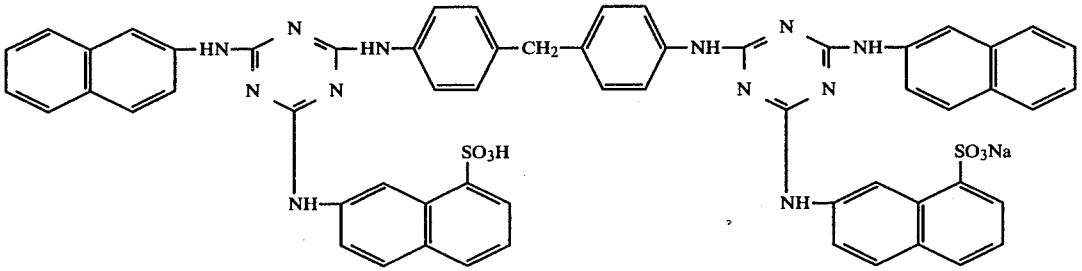
IV-20
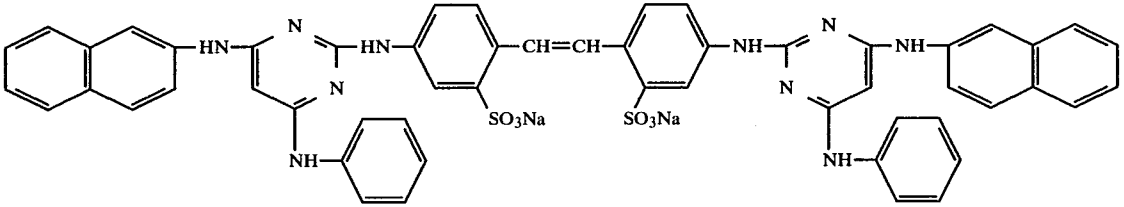
IV-21
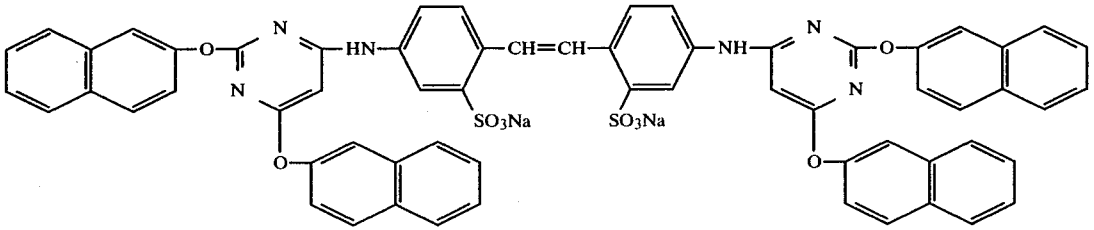

-continued
IV-22
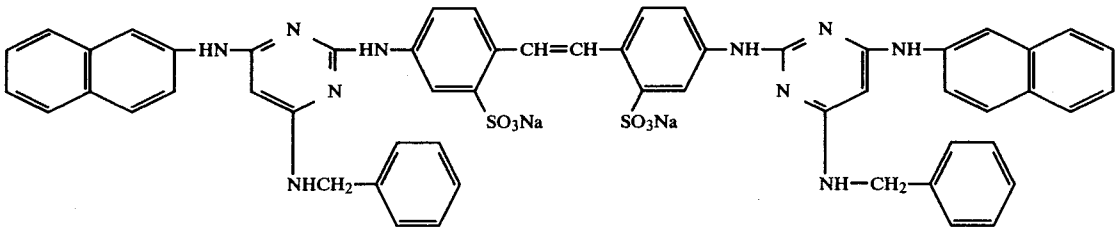
IV-23
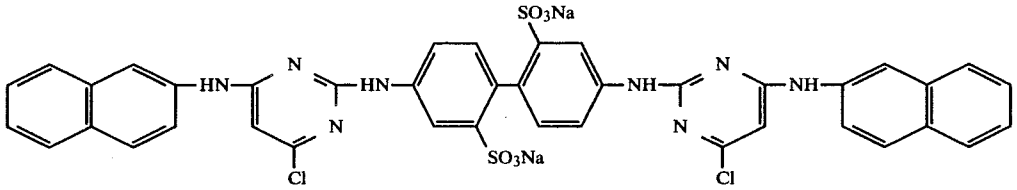
IV-24
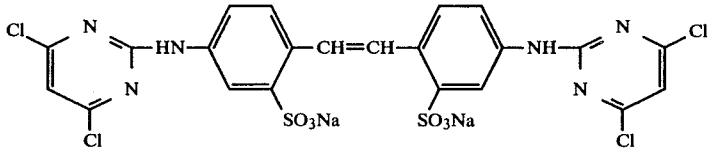
IV-25
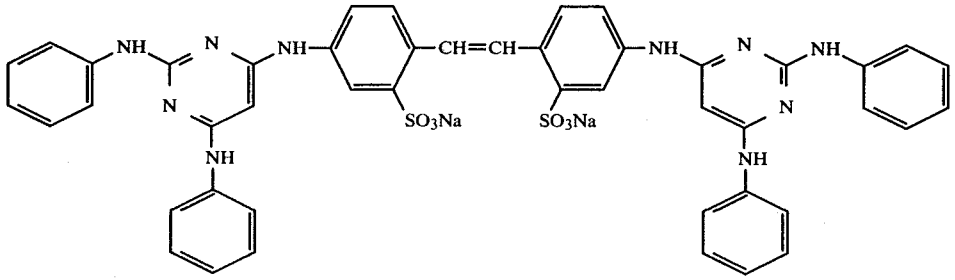

-continued
IV-26
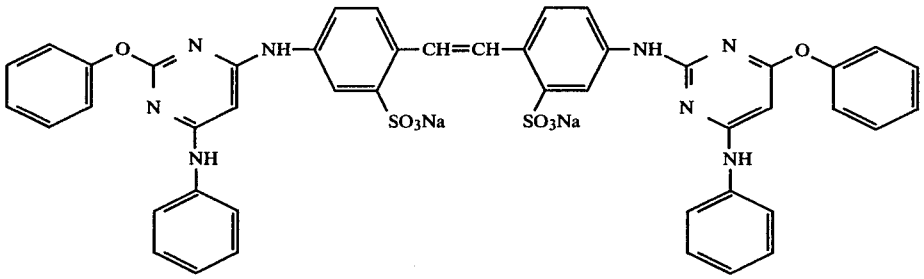
IV-27
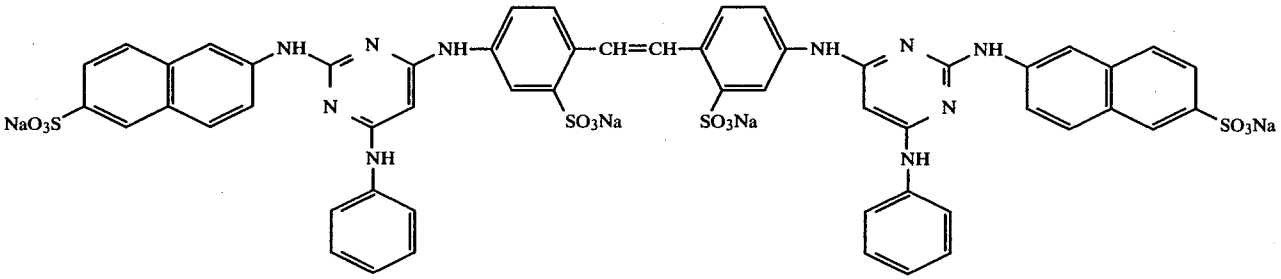

The amount of the compound represented by formula (IV) to be used together with the sensitizing dye represented by formula (I), (II) or (III) is suitably about 0.2 to about 200 times (by molar ratio) the amount of the sensitizing dye, preferably 1 to 30 times (by molar ratio) thereof.

The compound represented by formulae (I), (II) and (III) to be used in the present invention are known compounds, and may be synthesized in accordance with the methods described in Japanese patent application (OPI) No. 104917/77, Japanese patent publication Nos. 22884/68, 25652/73 and 22368/82; F. M. Hamer, *The Chemistry of Heterocyclic Compounds,* Vol. 18, "The Cyanine Dyes and Related Compounds", A. Weissberger ed., Interscience (New York, 1964); and D. M. Sturner, *The Chemistry of Heterocyclic Compounds,* Vol. 30, A, Weissberger and E. C. Taylor, eds., (John Wiley, New York, 1977, p. 441), etc.

In the addition of the dye represented by formula (I), (II) or (III) to the high silver chloride emulsion in the present invention, the dye can be added together with a water-soluble bromide, such as potassium bromide or the like, for the purpose of intensifying the adsorption properties of the dye, in accordance with the method described in Japanese patent publication No. 46932/74. The amount of the bromide to be added is preferably about 1 mol% or less, more preferably 0.5 mol% or less, per mol of silver halide.

The sensitizing dye represented by formula (I), (II) or (III) can be directly dispersed into the emulsion, or alternatively, the dye is first dissolved in either a single solvent such as water, methanol, ethanol, propanol, methyl cellosolve or 2,2,3,3-tetrafluoropropanol, or a mixture of these solvents, the resulting solution is then added to the emulsion. On the other hand, the sensitizing dye can be added into an aqueous solution in the presence of an acid or a base, as described, for example, in Japanese patent publication Nos. 23389/69, 27555/69, and 22089/82, or can be added into an aqueous solution or a colloidal dispersion in the presence of a surfactant, as described, for example, in U.S. Pat. Nos. 3,822,135 and 4,006,025, and then, the resulting aqueous solution or colloidal dispersion can be added to the emulsion. Further, sensitizing dye can be dissolved in a solvent which is not miscible with water, such as phenoxyethanol or the like, and thereafter dispersed in water or in a hydrophilic colloid, and the resulting dispersion can be added to the emulsion. In this connection, the sensitizing dye can be directly dispersed in a hydrophilic colloid as described, for example, in Japanese patent application (OPI) Nos. 102733/78 and 105141/83, and the resulting dispersion can be added to the emulsion The sensitizing dye is to be added to the emulsion at any stage during the preparation of the emulsion, which has heretofore been known to be suitable for such addition. Generally, however, dye is added during the period of from after the completion of chemical sensitization to before the coating. Apart from this, the sensitizing dye can be added at the same time as the chemical sensitizer whereby spectral sensitization and chemical sensitization are carried out at the same time, as described in U.S. Pat. Nos. 3,628,969 and 4,225,666; or, alternatively, the compound can be added prior to chemical sensitization, as described in Japanese patent application (OPI) No. 113928/83; still further, the compound can be added before the completion of the formation and precipitation of silver halide grains so as to initiate spectral sensitization before the completion thereof. As the case may be, the compound represented by formula (I), (II) or (III) can be added in separate portions; for example, one portion may be first added prior to chemical sensitization and the remaining portion added after chemical sensitization, as described in U.S. Pat. No. 4,225,666. In any event, the compound can be added to the emulsion in any stage in the formation of silver halide grains, for example, as proposed in U.S. Pat. No. 4,183,756.

The amount of the sensitizing dye represented by formula (I), (II) or (III) to be added to the emulsion is about $4\times10^{-6}$ to about $8\times10^{-3}$ mol per mol of silver halide in the silver halide emulsion in the light-sensitive layer which contains the high silver chloride emulsion. The silver halide grains preferably have an average particle size of from about 0.2 to about 1.3 μm; in this preferred case, the amount of the dye to be added to the emulsion is effectively from about $5\times10^{-5}$ to about $2\times10^{-3}$ mol per mol of silver halide in the emulsion.

In a preferred embodiment of the present invention, it is desirable that the color developer solution substantially excludes benzyl alcohol, for environmental reasons; i.e., the concentration of benzyl alcohol in the color developer is about 0.5 ml/liter or less, and more preferably, the color developer does not contain benzyl alcohol at all.

In a preferred embodiment of the present invention, the bromide ion concentration in the color developer is about 0.002 mol/liter or less, more preferably 0.0007 mol/liter or less; most preferably, the color developer does not contain any bromide ion at all. Of the concentration of the bromide ion in the color developer exceeds about 0.002 mol/liter, which has relation to the content of the silver bromide in a silver halide emulsion, development is inhibited and sufficient color density could hardly be attained in the images formed.

The silver halide emulsion to be used in the present invention substantially excludes silver iodide and comprises a slver halide containing silver chloride in an amount of about 80 mol% or more. The content of silver chloride in the emulsion is preferably 90 mol% or more, more preferably 95 mol% or more, and most preferably, the silver halide emulsion comprises purely silver chloride as the silver halide.

The silver halide emulsion of the present invention substantially excludes silver iodide, as mentioned above. In this connection, a slight amount of a water-soluble iodide compound, such as potassium iodide, is often used, for example, in an amount of about 0.5 mol% or less per mol of silver halide, in oder to increase the adsorption properties of the dye represented by formula (I), (II) or (III) or other cyanine dyes to the silver halide in the emulsion, or to increase the formation of J-association of these compounds or other cyanine dyes in the spectral sensitization of the emulsion therewith, thereby attaining a higher spectral sensitization of the emulsion. Also, it is known that silver halide is partly formed and precipitated on or near the surface of the silver halide grains because of this iodide compound, e.g., potassium iodide, having been previously added. However, in practical usage of the present invention, the content of silver iodide in the silver halide emulsion is about 1 mol% or less (including the above-noted silver iodide thus formed from the iodide compound), preferably 0.5 mol% or less, and most preferably, the silver halide emulsion of the present invention does not contain any silver iodide at all.

The amount of the silver halide as coated on a support is preferably 0.78 g/m$^2$ or less, based on the coated amount of silver. An excessive amount of the silver halide as coated would result in retardation of the development processing, and a sufficient color density could hardly be attained in the images formed.

The silver halide grains in the emulsion for use in the present invention preferably have a mean grain size of from about 0.1 μm to about 2 μm, more preferably from 0.2 μm to 1.3 μm, measured on the basis of the diameter of the equivalent projected area. In addition, the emulsion is preferably monodispersed, and the grain size distribution thereof, which is representative of the degree of monodispersibility of the emulsion, is preferably about 0.2 or less, more preferably 0.15 or less, measured by the ratio ($s/\bar{d}$) of the statistical standard deviation (s) to the mean grain size ($\bar{d}$).

The silver halide grains for use in the present invention may differ in composition or phase between the internal portion and the surface thereof, and the grains may have a multiphase structure having a junction structure, or may have a uniform phase or composition throughout the whole grain. Also, the silver halide grains may be composed of a mixture of such grains having different phase structures.

The silver halide grains for use in the present invention may have a regular crystal form or shape such as cubic, octahedral, dodecahedral, tetradecahedral, etc., or may have a irregular crystal form such as spherical. Further, the silver halide grains may be a composite form of these crystal forms. Also, a tabular grain silver halide emulsion can be used in the present invention. In particular, a tabular grain silver halide emulsion wherein tabular silver halide grains having an aspect ratio (length/width) of at least about 5, in particular, at least 8, account for at least 50% of the total projected area of the silver halide grains may be used. The silver halide emulsion also may be a mixture of above-noted emulsions containing silver halide grains having different crystal forms. Also, the silver halide grains may be of a surface latent image type capable of forming latent images mainly on the surfaces of the grains or may be of an internal latent image type capable of forming latent images mainly in the internal portion thereof.

The silver halide photographic emulsions for use in the present invention can be prepared using the methods described, for example, in P. Grafkides, *Chimie et Physical Photographique* (published by Paul Montel, 1967); G. F. Duffin, *Photographic Emulsion Chemistry (published by Focal Press,* 1966); V. L. Zelikman et al., *Making and Coating Photographic Emulsion* (published by Focal Press, 1964), etc.

For example, the silver halide emulsions may be prepared by an acid method, a neutralization method, an ammonia method, etc. Also, as a method of reacting a soluble silver salt and soluble halide(s), a single jet method, a double jet method, or a combination thereof may be used. A so-called reverse mixing method capable of forming silver halide grains in the presence of excessive silver ions can be employed. As one type of the double jet method, a so-called controlled double jet method of keeping a constant pAg in a liquid phase of forming silver halide grains can also be employed. According to this method, a silver halide emulsion containing silver halide grains having a regular crystal form and almost uniform grain sizes can be obtained.

Furthermore, a silver halide emulsion prepared by a so-called conversion method including a step of converting a silver halide already formed into a silver halide having a lower solubility product before the formation step of the silver halide grains is finished or a silver halide emulsion prepared by applying a similar halogen conversion to silver halide grains after completion of the formation step of the silver halide grains can also be used.

The silver halide grains may also be formed, or physically ripened, in the presence of a zinc salt, a lead salt, a thallium salt, an iridium salt or a complex salt thereof, a rhodium salt or a complex salt thereof, an iron salt or a complex salt thereof, etc.

After the formation of silver halide grains, the silver halide emulsion thus obtained is usually subjected to physical ripening, subjected to desalting, and then subjected to chemical ripening before coating.

In this case, a silver halide solvent (e.g., ammonia, potassium rhodanate, and the thioethers and thione compounds described in U.S. Pat. No. 3,271,157, Japanese patent application (OPI) Nos. 12360/76, 82408/78, 144319/78, 100717/79, 155828/79, etc.) can be used for the precipitation, physical ripening, and chemical ripening of the silver halide emulsion. For removing soluble salts from the silver halide emulsion after physical ripening, a noodle washing method, a flocculation setting method, an ultrafiltration method, etc., can be used.

For the chemical sensitization of the silver halide emulsions for use in the present invention, a sulfur sensitization method using active gelatin or a sulfur-containing compound capable of reacting with silver (e.g., thiosulfates, thioureas, mercapto compounds, rhodanines, etc.), a reduction sensitization method using a reducing material (e.g., stannous salts, amines, hydrazine derivatives, formamidinesulfinic acid, silane compounds, etc.), a noble metal sensitization method using a metal compound (e.g., gold complex salts and complex salts of metals belonging to group VIII of the Periodic Table, such as platinum, iridium, palladium, rhodium, iron, etc.) can be used individually or as a combination thereof.

The photographic light-sensitive materials for use in the present invention may contain an antifoggant as described, for example, in U.S. Pat. Nos. 3,954,474 and 3,982,947, Japanese patent publication No. 28660/77, *Research Disclosure,* No. 17643 December, 1978), Sections VIA to VIM, and E. J. Birr, *Stabilization of Photographic Silver Halide Emulsion* (by Focal Press, 1974); and in particular, hydroxytetraazaindenes such as 4-hydroxy-6-methyl-1,3,3a,7-tetraazaindene, etc., as well as mercapto-substituted heterocyclic compounds such as 1-[3-(3-methylureido)phenyl]-5-mercaptotetrazole, 1-(3-acetylaminophenyl)-5-mercaptotetrazole, 1-phenyl-5-mercaptotetrazole, 2-amino-5-mercaptothiadiazole, 3-hexanoylamino-4-methyl-5-mercapto-1,2,4-triazole, 2-mercaptobenzothiazole, etc. are especially preferred as the antifoggant.

For satisfying the gradation required for the color photographic light-sensitive materials of the present invention, two or more kinds of monodispersed silver halide emulsions (preferably having the above-described fluctuation as the monodispersibility) can be present in an emulsion layer having substantially the same color sensitivity as a mixture thereof or exist in two or more emulsion layers, respectively, each having substantially the same color sensitivity. Furthermore, two or more kinds of polydispersed silver halide emulsions or a combination of a monodispersed emulsion and a polydispersed emulsion can be used in one emulsion layer as a mixture thereof or in two or more layers, respectively.

The color coupler to be incorporated in the photographic light-sensitive materials of the present invention preferably has a ballast group or is polymerized so as to be rendered non-diffusive. Di-equivalent color couplers where the coupling active-position is substituted by a releasable group are preferred to tetra-equivalent color couplers having a hydrogen atom in the coupling-active position, since the amount of the silver to be coated can be reduced thereby. Further, couplers capable of forming colored dyes having the ability to diffuse between layers, non-coloring couplers, DIR-couplers capable of releasing a development-inhibitor in the coupling reaction, and couplers capable of releasing a development-accelerator in the coupling reaction can also be used.

Typical examples of yellow couplers which can be used in the present invention are oil-protected acylacetamide series couplers. Specific examples thereof are described, for example, in U.S. Pat. Nos. 2,407,210, 2,875,057 and 3,265,506. In the present invention, di-equivalent yellow couplers are preferably used; typical examples thereof are oxygen atom-releasing type yellow couplers as described, for example, in U.S. Pat. Nos. 3,408,194, 3,447,928, 3,933,501 and 4,022,620, and nitrogen atom-releasing type yellow couplers as described, for example, in Japanese patent publication No. 10739/83, U.S. Pat. Nos. 4,401,752 and 4,326,026, Research Disclosure, No. 18053 (April, 1979), British Pat. No. 1,425,020 and German Pat. (OLS) Nos. 2,219,917, 2,261,361, 2,329,587 and 2,533,812. α-Pivaloylacetanilide series couplers are excellent as to fastness, especially to light, of the colored dyes; and on the other hand, α-benzoylacetanilide series couplers are excellent for purposes of obtaining high color density.

Magenta couplers which can be used in the present invention include oil-protected indazolone series or cyanoacetyl series couplers, preferably 5-pyrazolone series couplers and pyrazoloazole series couplers such as pyrazolotriazoles. Among the 5-pyrazolone series couplers, those wherein the 3-position is substituted by an arylamino group or an acylamino group are preferred in view of the resulting hue and the color density of the colored dyes. Typical examples of these couplers are described, for example, in U.S. Pat. Nos. 2,311,082, 2,343,703, 2,600,788, 2,908,573, 3,062,653, 3,152,896 and 3,936,015. With respect to the releasable groups of the di-equivalent 5-pyrazolone series couplers, nitrogen atom-releasing groups as described in U.S. Pat. No. 4,310,619 and arylthio groups as described in U.S. Pat. No. 4,351,897 are especially preferred. In addition, ballast group-containing 5-pyrazolone series couplers as described in European Pat. No. 73,636 are preferred, as to obtaining color images of a high color density.

Pyrazoloazole series couplers which can be used in the present invention include pyrazolobenzimidazoles as described in U.S. Pat. No. 3,369,879, preferably pyrazolo[5,1-c][1,2,4]triazoles as described in U.S. Pat. No. 3,725,067, pyrazolotetrazoles as described in *Research Disclosure,* No. 24220 (June, 1984) and pyrazolopyrazoles as described in *Research Disclosure,* No. 24230 (June, 1984). In particular, imidazo[1,2-b]pyrazoles as described in European Pat. No. 119,741 are preferred because the yellow side-absorption of the thus-formed dyes is relatively small, and the lightfastness thereof is high; even more particularly, pyrazolo[1,5-b][1,2,4]triazoles as described in European Pat. No. 118,860 are preferred.

Cyan couplers which can be used in the present invention are oil-protected naphthol series and phenol series couplers; typical examples thereof are the naphthol series couplers described in U.S. Pat. No. 2,474,293, preferably the oxygen atom-releasing type di-equivalent naphthol series couplers described in U.S. Pat. Nos. 4,025,212, 4,146,396, 4,228,233 and 4,296,200. Concrete examples of phenol series couplers are described, for example, in U.S. Pat. Nos. 2,369,929, 2,801,171, 2,772,162 and 2,895,826. Cyan couplers which are fast to moisture and temperature are preferably used in the present invention, and typical examples thereof are phenol series cyan couplers wherein the phenol nucleus has an ethyl group or a higher alkyl group in the m-position, as described in U.S. Pat. No. 3,772,022; 2,5-diacylamino-substituted phenol series couplers as described in U.S. Pat. Nos. 2,772,162, 3,758,308, 4,126,396, 4,344,011 and 4,327,173, German Pat. (OLS) No. 3,329,729 and Japanese patent application No. 42671/83; and phenol series couplers having a 2-phenylureido group and a 5-acylamino group, as described in U.S. Pat. Nos. 3,446,622, 4,333,999, 4,451,559 and 4,427,767.

The graininess can be improved by the incorporation of a coupler capable of forming a colored dye with the requisite diffusiveness. Specific examples of such dye-diffusive couplers are the magenta couplers described in U.S. Pat. No. 4,366,237 and British Pat. No. 2,125,570 and the yellow, magenta and cyan couplers described in European Pat. No. 96,570 and German Pat. (OLS) No. 3,234,533.

The dye-forming couplers and the above-mentioned special couplers may be in the form of a dimer or higher polymer. Typical examples of polymerized dye-forming couplers are described in U.S. Pat. Nos. 3,451,820 and 4,080,211. Specific examples of polymerized magenta couplers are described in British Pat. No. 2,102,173 and U.S. Pat. No. 4,367,282.

With respect to the incorporation of the couplers in the photographic materials of the present invention, the above-described couplers may be employed as combinations of two or more types thereof in the same photographic layer in order to result in photographic characteristics required for a color photographic light-sensitive material; alternatively, the same type of coupler may be incorporated in two or more photographic layers.

The couplers for use in the present invention can be incorporated in the color photographic light-sensitive materials by the oil-in-water dispersion method. According to this method, the coupler is first dissolved either in a single solution comprising one solvent selected from among high boiling point organic solvents having a boiling point of about 175° C. or higher and so-called auxiliary solvents having a low boiling point, or in a mixed solution comprising both types of these solvents, and then the resulting solution is finely dispersed in an aqueous medium such as water or a gelatin-aqueous solution in the presence of a surfactant. Examples of suitable high boiling point organic solvents are described in U.S. Pat. No. 2,322,027. The dispersion may be accompanied by phase inversion, if desired. The auxiliary solvent used may be removed or reduced by distillation, noodle washing or ultrafiltration, prior to coating the resulting emulsion onto a support.

Specific examples of the high boiling point organic solvents include phthalates such as dibutyl phthalate, dicyclohexyl phthalate, di-2-ethylhexyl phthalate, decyl phthalate, etc., phosphates or phosphonates such as triphenyl phosphate, tricresyl phosphate, 2-ethylhexyl-diphenyl phosphate, tricyclohexyl phosphate, tri-2-ethylhexyl phosphate, tridecyl phosphate, tributoxyethyl phosphate, trichloropropyl phosphate, di-2-ethylhexyl-phenyl phosphate, etc., benzoates such as 2-ethylhexyl benzoate, dodecyl benzoate, 2-ethylhexyl-p-hydroxybenzoate, etc., amides such as diethyl-dodecanamide, N-tetradecylpyrrolidone, etc., alcohols and phenols such as isostearyl alcohol, 2,4-di-tert-amylphenol, etc., aliphatic carboxylates such as dioctyl azelate, glycerol tributyrate, isostearyl lactate, trioctyl citrate, etc., aniline derivatives such as N,N-dibutyl-2-butoxy-5-tert-octylaniline, etc. hydrocarbons such as paraffin, dodecylbenzene, diisopropylnaphthalene, etc. Auxiliary solvents which can be used herein include organic solvents having a boiling point of about 30° C. or higher, and preferably from 50° C. to about 160° C., and typical examples thereof are ethyl acetate, butyl acetate, ethyl propionate, methylethylketone, cyclohexanone, 2-ethoxyethyl acetate, dimethylformamide, etc.

The couplers can also be incorporated in the color photographic light-sensitive materials of the present invention by a latex dispersion method. This method, as well as the effects thereof and specific examples of latexes to be used for impregnation are described in U.S. Pat. No. 4,199,363 and German Pat. (OLS) Nos. 2,541,274 and 2,541,230.

The standard amount of the color coupler to be used is in the range of from about 0.001 to about 1 mol per mol of light-sensitive silver halide of the silver halide emulsion, and the preferred amount is from 0.01 to 0.5 mol for the yellow couplers, from 0.003 to 0.3 mol for the magenta couplers and from 0.002 to 0.3 mol for the cyan couplers.

The photographic light-sensitive materials for use in the present invention may also contain hydroquinone derivatives, aminophenol derivatives, amines, gallic acid derivatives, catechol derivatives, ascorbic acid derivatives, colorless compound-forming couplers, sulfonamidophenol derivatives, etc., as color fog preventing agents or color mixing preventing agents.

Also, the photographic light-sensitive materials of the present invention may further contain known anti-fading agents. Examples of organic anti-fading agents include hindered phenols such as hydroquinones, 6-hydroxychromans, 5-hydroxycoumarins, spirochromans, p-alkoxyphenols, or bisphenols, gallic acid derivatives, methylenedioxybenzenes, aminophenols, hindered amines, and also the ether or ester derivatives obtained by silylating or alkylating the phenolic hydroxy groups of these compounds. Also, metal complexes such as (bissalicylaldoximate) nickel complexes and (bis-N,N-dialkyldithiocarbamate) nickel complexes can be used as the anti-fading agent.

The use of a compound having both the moiety structure of a hindered amine and a hindered phenol in the same molecule as described in U.S. Pat. No. 4,268,593 for the color photographic materials gives good results for preventing the deterioration of the yellow dye images by heat, humidity, and light. Also, for preventing the deterioration of magenta dye images, particularly by light, the use of the spiroindanes described in Japanese patent application (OPI) No. 159644/81 or the chromans having a hydroquinone diether or monoether as a substituent described in Japanese patent application (OPI) No. 89835/80 gives preferred results.

For improving the stability of cyan dye images, in particular the light fastness thereof, it is preferred to use benzotriazole series ultraviolet absorbents for the color photographic materials. The ultraviolet absorbent may be co-emulsified with a cyan coupler.

The ultraviolet absorbent may be used in a coating amount sufficient for imparting light stability to the cyan dye images formed, but if too great an amount of the ultraviolet absorbent is used, yellowing sometimes occurs at the unexposed portions (background portions) of color photographic light-sensitive material after processing, and hence the amount is usually in the range of from about $1\times10^{-4}$ mol/m$^2$ to about $2\times10^{-3}$ mol/m$^2$, preferably from $5\times10^{-4}$ to $1.5\times10^{-3}$ mol/m$^2$.

In an ordinary layer constitution of color photographic light-sensitive materials for use in the present invention, an ultraviolet absorbent is present in one or preferably both layers disposed at both sides of a cyan coupler-containing red-sensitive silver halide emulsion layer. Also, when an ultraviolet absorbent is incorporated in an interlayer between a green-sensitive emulsion layer and a red-sensitive emulsion layer, the ultraviolet absorbent may be co-emulsified with a color mixing preventing agent. When an ultraviolet absorbent is present in a protective layer, another protective layer may be formed as the outermost layer and the protective layer may contain a matting agent, optionally having specific particle sizes. Moreover, the photographic materials of the present invention may contain ultraviolet absorbents in hydrophilic colloid layers thereof.

The photographic materials of the present invention may further contain water-soluble dyes in the hydrophilic colloidal layers thereof as filter dyes or for the purposes of irradiation prevention, halation prevention, etc.

The photographic materials of the present invention may further contain brightening agents such as stilbene series compounds, triazine series compounds, oxazole series compounds, coumarin series compounds, etc., in the photographic emulsion layers or other hydrophilic colloid layers. In this case, as the brightening agents, water-soluble brightening agents may be used or non-water soluble brightening agents may be used in the form of a dispersion thereof.

It is preferred that the photographic light-sensitive material of the present invention comprises suitable auxiliary layers, such as one or more protective layers, interlayers, a filter layer, an antihalation layer, a backing layer, etc., in addition to silver halide emulsion layers.

A suitable binder or protective colloid which can be used for the emulsion layer, interlayers, etc., of the photographic materials in the present invention is gelatin, but other hydrophilic colloids can also be used.

For example, proteins such as gelatin derivatives, graft polymers of gelatin and other polymers, albumin, casein, etc.; cellulose derivatives such as hydroxyethyl cellulose, carboxymethyl cellulose, cellulose sulfates, etc.; saccharose derivatives such as sodium alginate, starch derivatives, etc.; and various synthetic hydrophilic polymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc. may be used as the binder or protective colloid.

The specific gelatin which may be used includes lime-processed gelatin as well as acid-processed gelatin or the enzyme-processed gelatin described in *Journal of the*

*Society of Photographic Science and Technology of Japan,* No. 16, p. 30 (1966). Also, the hydrolyzed products or enzyme decomposed products of gelatin can be used.

The photographic materials in the present invention may further contain various stabilizers, stain preventing agents, developing agents or precursors thereof, development accelerators or precursors thereof, lubricants, mordants, matting agents, antistatic agents, plasticizers and other additives useful for the photographic materials in addition to the above-described additives. Examples of these additives are described in *Research Disclosure,* No. 17643 (December, 1978) and *Research Disclosure,* No. 18716 (November, 1979).

The support for use in the present invention is preferably a reflective support. The "reflective support" has a high reflectivity for clearly viewing dye images formed in silver halide emulsion layers of the color photographic material. Such a reflective support comprises a support coated with a hydrophobic resin having dispersed therein a light reflective material such as titanium oxide, zinc oxide, calcium carbonate, calcium sulfate, etc., and a support composed of a hydrophobic resin having dispersed therein a light reflective materials as described above. Examples of the reflective support include baryta-coated papers, polyethylene-coated papers, polypropylene series synthetic papers, and transparent supports (e.g., glass plates, polyester films such as polyethylene terephthalate films, cellulose triacetate films, or cellulose nitrate films, polyamide films, polycarbonate films, polystyrene films, etc.) having a reflective layer or containing a reflective material. These supports can be appropriately selected according to the intended purposes.

The processing steps (image-forming steps) of the present invention is described in detail hereinafter.

The overall processing time in the color development of the photographic material of the present invention is short, being at most about 2 min and 30 sec. The preferred processing time is from 10 sec to 2 min. The term "processing time" in the development step means the time from when a silver halide color photographic material first contacts a color developer solution to the time of contact with a subsequent processing solution, and thus includes the travelling time of the photographic material from the development bath to the subsequent processing bath.

The aromatic primary amine color developing agent contained in the color developer solution for use in the present invention includes a variety of known substances which have widely been used in a conventional color photographic processes. For example, the developing agent includes aminophenol series and p-phenylenediamine series derivatives. Preferred examples thereof are p-phenylenediamine derivatives, etc. Specific examples thereof are illustrated below, but the developing agents for use in the present invention are not limited to these compounds:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(-hydroxyethyl)amino]aniline
D-5: 2-methyl-4-[N-ethyl-N-( -hydroxyethyl)amino]aniline
D-6: N-ethyl-N-( -methanesulfonamidoethyl)-3-methyl-4-aminoaniline
D-7: N-(2-amino-5-diethylaminophenylethyl)methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N- -ethoxyethylaniline
D-11: 4-amino-3-methyl-N-ethyl-N- -butoxyethylaniline Also, the p-phenylenediamine derivative may be used as a form of the salt thereof, such as the sulfate, hydrochloride, sulfite, p-toluenesulfonate, etc.

The above-mentioned compounds are described, for example, in U.S. Pat. Nos. 2,193,015, 2,552,241, 2,566,271, 2,592,364, 3,656,950 and 3,698,525. The amount of the aromatic primary amine developing agent is from about 0.1 g to about 20 g, and preferably from about 0.5 g to about 10 g, per liter of a developer solution.

The color developer for use in the present invention may further contain a known hydroxylamine compound. The hydroxylamine may be used in the form of a free amine in the color developer, but is generally used in the form of a water-soluble acid salt thereof. Examples of such a salt of hydroxylamine include sulfates, oxalates, chlorides, phosphates, carbonates, acetates, etc. The hydroxylamine may be substituted or unsubstituted. For example, the nitrogen atom of the hydroxylamine may be mono- or di-substituted by one or more alkyl groups.

The amount of the hydroxylamine to be added is preferably up to about 10 g, more prefereably up to 5 g, per liter of the color developer. The amount thereof is preferably as small as possible, provided that the stability of the color developer can be maintained in view of the generation of fog.

The color developer for use in the present invention may further contain a preservative, such as a sulfite, including sodium sulfite, potassium sulfite, sodium bisulfite, potassium bisulfite, sodium meta-sulfite or potassium meta-sulfite, or a carbonyl-sulfite adduct. The amount of the preservative to be incorporated is preferably up to about 20 g/liter, and more preferably up to 5 g/liter, and the amount is preferably as small as possible provided that the stability of the color developer can be maintained.

Other preservatives which can be used in the present invention are aromatic polyhydroxy compounds as described in Japanese patent application (OPI) Nos. 49828/77, 47038/81, 32140/81 and 160142/84 and U.S. Pat. No. 3,746,544; hydroxyacetones as described in U.S. Pat. No. 3,615,503 and British Pat. No. 1,306,176; $\alpha$-aminocarbonyl compounds as described in Japanese patent application (OPI) Nos. 143020/77 and 89425/78; various kinds of metals as described in Japanese patent application (OPI) Nos. 44148/82 and 53749/82; various kinds of saccharides as described in Japanese patent application (OPI) No. 102727/77; hydroxamic acids as described in Japanese patent application (OPI) No. 27638/77; $\alpha,\alpha'$-dicarbonyl compounds as described in Japanese patent application (OPI) No. 160141/84, salicylic acids as described in Japanese patent application (OPI) No. 180588/84; alkanolamines as described in Japanese patent application (OPI) No. 3532/79; poly(alkylenimies) as described in Japanese patent application (OPI) No. 94349/81; gluconic acid derivatives as described in Japanese patent application (OPI) No. 75647/81, etc. Two or more kinds of preservatives can be used together, if desired. In particular, 4,5-dihydroxy-m-benzenedisulfonic acid, poly(ethylenimine), triethanolamine, etc. are preferably used.

The color developer solution to be used in the present invention preferably has a pH of from about 9 to about 12, and more preferably has a pH of from 9 to 11.0. The color developer solution may further contain other known developer components, if desired.

In order to maintain the pH of the developer solution within the above-mentioned range, the use of various kinds of buffers is preferred. Buffers which can be used therefor include, for example, carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, etc. In particular, carbonates, phosphates, tetraborates and hydroxybenzoates have high dissolubility and high buffer capacity in a high pH range of pH 9.0 or more, and thus the use of these buffers are especially preferred, since these buffers have the additional advantages that the addition thereof to color developer solutions does not cause any adverse influence (such as fog) on the photographic characteristics of the developer solution, and further they are inexpensive.

Specific examples of these buffers are sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. However, the present invention is not limited to the use of these compounds.

The concentration of the buffer in the color developer is preferably about 0.1 mol/liter or more, and particularly preferably from 0.1 mol/liter to 0.4 mol/liter.

Furthermore, the color developer may contain a variety of chelating agents for preventing the precipitation of calcium, magnesium, etc. or for improving the stability of the color developer.

Preferred chelating agents are organic acid compounds, including amino-polycarboxylic acids as described in Japanese Patent Publication Nos. 30496/73 and 30232/69; organic phosphonic acids as described in Japanese Patent Application (OPI) No. 97347/81, Japanese Patent Publication No. 39359/81 and German Pat. No. 2,227,639; phosphonocarboxylic acids as described in Japanese Patent Application (OPI) Nos. 102726/77, 42730/78, 121127/79, 126241/80 and 65956/80; and the compounds as described in Japanese Patent Application (OPI) Nos. 195845/83 and 203440/83 and Japanese Patent Publication No. 40900/78. Specific examples of such chelating agents are set forth below; the present invention, however, is not limited to the compounds.

Nitrilo-triacetic acid,
Diethylenetriamine-pentaacetic acid,
Triethylenetetramine-hexaacetic acid,
Ethylenediamine-tetraacetic acid,
N,N,N-trimethylene-phosphonic acid,
Ethylenediamine-N,N,N',N'-tetramethylene-phosphonic acid,
1,3-diamino-2-propanol-tetraacetic acid,
Trans-cyclohexanediamine-tetraacetic acid,
Nitrilo-tripropionic acid,
1,2-diaminopropane-tetraacetic acid,
Hydroxyethylimino-diacetic acid,
Glycoletherdiamine-tetraacetic acid,
Hydroxyethylenediamine-triacetic acid,
Ethylenediamine-orthohydroxyphenyl-acetic acid,
2-phosphonobutane-1,2,4-tricarboxylic acid,
1-hydroxyethane-1,1-diphosphonic acid,
N,N-bis(2-hydroxybenzyl)ethylenediamine-N,N'-diacetic acid.

These chelating agents can be used in the form of a combination of two or more thereof, if desired. The amount of the chelating agent to be added to the color developer solution may be a sufficient functional amount so as to tie up the metal ions in the color developer. For instance, the amount is from about 0.1 to about 10 g per liter of the developer solution.

The color developers of the present invention may further contain various kinds of development accelerators.

The development accelerators include, for example, thioether series compounds as described in Japanese Patent Publication Nos. 16088/62, 5987/62, 7826/63, 12380/69 and 9019/70 and U.S. Pat. No. 3,813,247; p-phenylenediamine series compound as described in Japanese Patent Application (OPI) Nos. 49829/77 and 15554/75; quaternary ammonium salts as described in Japanese Patent Application (OPI) Nos. 137726/75, Japanese Patent Publication No. 30074/69, Japanese Patent Application (OPI) Nos. 156826/81 and 43429/77; p-aminophenol compounds as described in U.S. Pat. Nos. 2,610,122 and 4,119,462; amine series compounds as described in U.S. Pat. Nos. 2,494,903, 3,128,182, 4,230,796 and 3,253,919, Japanese Patent Publication No. 11431/76, U.S. Pat. Nos. 2,482,546, 2,596,926 and 3,582,346; polyalkyleneoxide compounds as described in Japanese Patent Publication Nos. 16088/62 and 25201/67, U.S. Pat. No. 3,128,183, Japanese Patent Publication Nos. 11431/76 and 23883/77 and U.S. Pat. No. 3,532,501; and 1-phenyl-3-pyrazolidone compounds, hydrazine compounds, mesoionic type compounds, thione series compounds, imidazole compounds and similar compounds capable of accelerating development. In particular, thioether-type compounds and 1-phenyl-3-pyrazolidone compounds are preferred.

A slight amount of a bromide can be added to the color developer for use in the present invention for the purpose of maintaining uniformity of development. The concentration of the bromide ion therein is, as mentioned above, about 0.002 mol/liter or less, preferably 0.0007 mol/liter or less.

The color developer for use in the present invention can contain an antifoggant, if necessary. Suitable antifoggants include alkali metal halides such as potassium bromide, sodium chloride or potassium iodide or other organic antifoggants. Specific examples of organic antifoggants for use in the present invention include, for example, nitrogen-containing heterocyclic compounds such as benzotriazole, 6-nitrobenzimidazole, 5-nitroisoindazole, 5-methylbenzotriazole, 5-nitrobenzotriazole, 5-chloro-benzotriazole, 2-thiazolyl-benzimidazole or hydroxyazaindolidine; mercapto-substituted heterocyclic compounds such as 2-mercaptobenzimidazole, 1-[3-(3-methylureido)phenyl]-5-mercaptotetrazole, 1-(3-acetylaminophenyl)-5-mercaptotetrazole, 2-amino-5-mercaptothiadiazole, 3-hexanoylamino-4-methyl-5-mercapto-1,2,4-triazole, 2-mercaptobenzothiazole, etc.; adenine; and mercapto-substituted aromatic compounds such as thio-salicylic acid, etc. The antifoggant can be incorporated in the color photographic light-sensitive material in such a manner that it may be dissolved out from the material during the processing thereof to thereby exist in the color developer solution. In this case, the amount of the antifoggant present in the color developer is preferably as small as possible for reducing the amount of the waste liquid during the development processing.

The color developers of the present invention preferably also contain a brightening agent, and 4,4'-diamino-2,2'-disulfostilbene series compounds are preferred. The amount thereof to be added to the developer is preferably up to about 5 g/liter, and more preferably from 0.1 to 4 g/liter.

If desired, various kinds of surfactants can be added to the developer, including alkylsulfonic acids, arylsulfonic acids, aliphatic carboxylic acids and aromatic carboxylic acids.

The processing temperature of the color developer solution of the present invention is preferably from about 30° C. to about 50° C., and more preferably from 32° C. to 42° C. The amount of the replenisher is from about 30 ml to about 2000 ml, and more preferably from 30 ml to 1500 ml, per $m^2$ of the photographic light-sensitive material to be processed. The amount of the replenisher is preferably as small as possible for reducing the amount of the waste liquid during the development processing.

Suitable bleaching agents which can be used in the bleaching solution or bleach-fixing solution for use in the present invention include ferric complexes as well as complexes comprising a ferric ion and a chelating agent such as an amino-polycarboxylic acid, an amino-polyphosphonic acid or a salt thereof. The salts of amino-polycarboxylic acids or amino-polyphosphonic acids are alkali metal, ammonium or water-soluble amine salts of these acids. Suitable alkali metal include sodium, potassium lithium, etc.; the water-soluble amine include alkylamines such as methylamine, diethylamine, triethylamine or butylamine, alicyclic amines such as cyclohexylamine, arylamines such as aniline or m-toluidine, and heterocyclic amines such as pyridine, morpholine or piperidine.

Specific examples of the chelating agents including the amino-polycarboxylic acids, amino-polyphosphonic acids and salts thereof are set forth below, but are not to be construed as limitative:

Ethylenediamine-tetraacetic acid
Disodium ethylenediamine-tetraacetate
Diammonium ethylenediamine-tetraacetate
Tetra(trimethylammonium) ethylenediamine-tetraacetate
Tetrapotassium ethylenediamine-tetraacetate
Tetrasodium ethylenediamine-tetraacetate
Trisodium ethylenediamine-tetraacetate
Diethylenetriamine-pentaacetic acid
Pentasodium diethylenetriamine-pentaacetate
Ethylenediamine-N-(β-hydroxyethyl)-N,N',N'-triacetic acid
Trisodium ethylenediamine-N-(β-hydroxyethyl)-N,N∝,N'-triacetate
Triammonium ethylenediamine-N-(β-hydroxyethyl)-N,N',N'-triacetate
Propylenediamine-tetraacetic acid
Disodium propylenediamine-tetraacetate
Nitrilotriacetic acid
Trisodium nitrilotriacetate
Cyclohexanediamine-tetraacetic acid
Disodium cyclohexanediamine-tetraacetic acid
Iminodiacetic acid
Dihydroxyethylglycine
Ethyletherdiamine-tetraacetic acid
Glycoletherdiamine-tetraacetic acid
Ethylenediamine-tetrapropionic acid
Phenylenediamine-tetraacetic acid
1,3-Diaminopropanol-N,N,N',N'-tetramethylenephosphonic acid
Ethylenediamine-N,N,N',N'-tetramethylene-phosphonic acid.

The ferric complexes can be used in the form of the complexes themselves, or alternatively, the ferric complexes can be formed in situ in the solution from a ferric salt such as ferric sulfate, ferric chloride, ferric nitrate, ammonium ferric sulfate, ferric phosphate, etc. and a chelating agent such as an amino-polycarboxylic acid, aminopolyphosphonic acid, phosphono-carboxylic acid, etc. If the ferric complexes themselves are used, a single complex can be added to the solution, or a combination of two or more complexes can be added thereto. On the other hand, if the complex is to be formed in situ in the solution, using the ferric salt and the chelating agent, one or more kinds of the ferric salts can be used. In addition, the chelating agent can also be used singly or in the form of a combination of two or more thereof. In any event, an excess amount of the chelating agent can be used over that required to form the ferric complex. Of the iron complexes, aminopolycarboxylic acid-/iron complexes are preferred, and the amount thereof to be added is from about 0.01 mol/liter to about 1.0 mol/liter, and more preferably from 0.05 mol/liter to 0.50 mol/liter.

Further, the bleaching solution or the bleach-fixing solution can contain, if desired, a bleaching accelerator. Specific examples of useful bleaching accelerators include mercapto group- or disulfide group-containing compounds as described in U.S Pat. No. 3,893,858, German Pat. Nos. 1,290,812 and 2,059,988, Japanese Patent Application (OPI) Nos. 32736/78, 57831/78, 37418/78, 65732/78, 72623/78, 95630/78, 85631/78, 104232/78, 124424/78, 141623/78 and 28426/78 and *Research Disclosure,* No. 17129 (July, 1978); thiazolidine derivatives as described in Japanese Patent Application (OPI) No. 140129/75; thiourea derivatives as described in Japanese Patent Publication Nos. 8506/70, 20832/77 and 32735/78, and U.S. Pat. No. 3,706,561; iodide compounds as described in German Pat. No. 1,127,715 and Japanese Patent Application (OPI) No. 16235/83; polyethyleneoxide compounds as described in German Pat. Nos. 966,410 and 2,748,430; polyamine compounds as described in Japanese Patent Publication No. 8836/70; and compounds as described in Japanese Patent Application (OPI) Nos. 42434/74, 59644/74, 94927/78, 35727/79, 26506/80 and 163940/83, and iodide or bromide ion, etc. In particular, mercapto group- or disulfide group-containing compounds are preferred, as having a high acceleration effect, and especially preferred are compounds as described in U.S. Pat. No. 3,893,858, German Pat. No. 1,290,812 and Japanese Patent Application (OPI) No. 95630/78.

Further, the bleaching solution or bleach-fixing solution of the present invention may contain a rehalogenating agent selected from bromide such as potassium bromide, sodium bromide and ammonium bromide, chlorides such as potassium chloride, sodium chloride and ammonium chloride, and iodides such as ammonium iodide. If desired, the solution may further contain one or more organic acids and inorganic acids having a pH-buffering capacity and alkali metal or ammonium salts thereof, such as boric acid, borax, sodium metaborate, acetic acid, sodium acetate, sodium carbonate, potassium carbonate, phosphorous acid, phosphoric acid, sodium phosphate, citric acid, sodium citrate and tartaric acid, or a corrosion-inhibitor such as ammonium nitrate or guanidine.

The fixing agent to be used in the bleach-fixing solution or fixing solution for use in the present invention may be a known fixing agent, for example, selected from water-soluble silver halide solubilizing agents such as thiosulfate compounds including sodium thiosulfate, ammonium thiosulfate, etc.; thiocyanate compounds including sodium thiocyanate, ammonium thiocyanate, etc.; thioether compounds including ethylenebis-thioglycolic acid, 3,6-dithia-1,8-octanediol; and thiourea compounds, etc. These fixing agents can be used singly or in the form of a mixture of two or more thereof. In addition, a special bleach-fixing solution comprising the combination of a fixing agent and a large amount of halide such as potassium iodide, as described in Japanese Patent Application (OPI) No. 155354/80, can also be used in the present invention. In the practice of the present invention, the use of thiosulfate compounds, especially ammonium thiosulfate compounds, is preferred.

The amount of the fixing agent in the bleach-fixing solution or fixing solution is preferably within the range of about 0.3 to about 3 mole, more preferably from 0.5 to 1.0 mole, per liter of the solution.

One characteristic feature of the present invention is the rapid processing in the bleach-fixation step, which requires about 75 seconds or less. Preferably, the present invention requires bleach-fixation processing for only 60 seconds or less.

The pH range of the bleach-fixing solution or fixing solution for use in the present invention is preferably up to about 6.5 or less, more preferably up to 6.0 or less. In particular, the pH range is preferably as small as possible for attaining suitable rapid bleach-fixation.

If the pH of the solution is too high, the removal of silver is suppressed and the generation of stain is accelerated.

In order to adjust the pH value of the solution, hydrochloric acid, sulfuric acid, nitric acid, acetic acid (glacial acetic acid), bicarbonates, ammonia, potassium hydroxide, sodium hydroxide, sodium carbonate, potassium carbonate, or the like can be added to the solution, if desired.

In addition, the bleach-fixing solution can further contain other various kinds of brightening agents, defoaming agents or surfactants as well as organic solvents such as polyvinyl pyrrolidone or methanol.

The bleach-fixing solution or fixing solution for use in the present invention contains, as a preservative, a compound capable of releasing a sulfite ion, such as sulfites (e.g., sodium sulfite, potassium sulfite, ammonium sulfite, etc.), bisulfites (e.g., ammonium bisulfite, sodium bisulfite, potassium bisulfite, etc.), meta-bisulfites (e.g., potassium meta-bisulfite, meta-bisulfite, ammonium meta-bisulfite, etc.). The compound is preferably added to the solution in an amount of from about 0.02 mol/liter ot about 0.50 mol/liter, more preferably from 0.04 mol/liter to 0.40 mol/liter, in terms of the sulfite ion thereof.

A sulfite compound is generally added to the solution as a preservative. In addition, other compounds such as ascorbic acid, carbonylbisulfite adducts or carbonyl compounds can also be used as the preservative.

Further, a buffer, a brightening agent, a chelating agent, a fungicide, etc. can also be added to the solution, if desired.

The washing step in the practice of the present invention is explained in detail hereafter. In the process of the present invention, a simple processing can be applied to the photographic light-sensitive materials, which comprises only a so-called "stabilization" in place of the conventional "water-washing step" and which does not contain any substantial water-washing. Accordingly, the term "washing" as used in the process of the present invention has a broad meaning, including mere stabilization as indicated above.

The amount of the water to be used in the washing step is difficult to define with particularity, since the amount varies, depending upon the number of bath used for the multi-stage countercurrent washing and depending upon the amount of the components of the previous bath which are carried over from the previous bath together with the photographic light-sensitive material as it is being processed. In the practice of the present invention, this amount can be defined so that the amount of the component of the bleaching fixing solution in the last washing bath is about $1\times10^{-4}$ (volume/volume) or less. For instance, if a three-tank countercurrent washing system is used, the washing water is preferably used in an amount of about 1000 ml or more, more preferably 5000 ml or more, per $m^2$ of the photographic light-sensitive material being processed. For economization of the amount of water used, the amount of water may be 100 to 1000 ml, per $m^2$ of the material.

The washing temperature is from about 15° C. to about 45° C., and more preferably, from 20° C. to 35° C.

Various kinds of known compounds can be added to the washing solution, for the purpose of preventing the formation of precipitates in the washing solution or for stabilizing the solution. For instance, chelating agents such as inorganic phosphoric acid, amino-polycarboxylic acids, organic phosphonic acids, etc.; germicides or fungicides for preventing the propagation of various kinds of bacteria, fungi and algae, such as the compounds described in *J. Antibact. Antifung. Agents,* Vol. 11, No. 5, pp. 207–223 (1983) and the compounds described in H. Horiguchi, *Antibacterial and Antifungal Chemistry,* 1982, Sankyo Shuppan; metal salts such as magnesium salts or aluminum salts; alkali metal or ammonium salts; and surfactants for preventing the drying load or unevenness can be added to the washing solution, if desired. Further, the compounds as described in West, *Photographic Science and Engineering,* Vol. 6, pp. 344–359 (1965) can also be added to the solution.

The process of the present invention is especially effective in the situation where a chelating agent or a bactericidal or fungicidal agent is additionally incorporated in the washing solution so that the amount of the washing water to be used is noticeably reduced by the use of a multi-stage countercurrent washing system using two or more washing tanks. In addition, the present invention is also especially effective in the situation where the multistage countercurrent stabilization step (or a so-called stabilization step) as described in Japanese Patent Application (OPI) No. 8543/82 is utilized in place of the conventional water-washing step. In these preferred cases, the above-described components of the bleach-fixing solution in the last bath may be $5\times10^{-2}$ (volume/volume) or less, preferably $1\times10^{-2}$ (volume/volume) or less.

Various kinds of compounds can be added to the stabilizer bath for the purpose of stabilizing the images formed. Specific examples of such additives include a variety of buffers for regulating the film pH (for example, to pH of from about 3 to about 8), such as borates, metaborates, borax, phosphates, carbonates, potassium hydroxide, sodium hydroxide, aqueous ammonia, monocarboxylic acids, dicarboxylic acids, polycarboxylic acids, etc., in the form of combinations thereof; as well as aldehydes such as formalin, etc. In addition, other various kinds of additives including chelating agents, such as inorganic phosphoric acids, aminopolycarboxylic acids, organic phosphonic acids, aminopolyphosphonic acids, phosphono-carboxylic acids, etc.; germicides, such as thiazole series compound, isothiazole series compounds, halogenated phenols, sulfanylamides, benzotriazoles, etc.; surfactants, brightening agents, hardeners, etc. can also be used. These additives can be used singly or in the form of a combination of two or more different kinds of compounds.

It is preferred to add a variety of ammonium salts such as ammonium chloride, ammonium nitrate, ammonium sulfate, ammonium phosphate, ammonium sulfite, ammonium thiosulfate, etc., to the photographic materials being processed, as a film pH-regulating agent, for improving the storage stability of the formed images.

If the amount of the washing water is remarkably reduced for purposes of economization as mentioned above, a part or all of the over-flow solution of the washing water is preferably re-circulated to the previous bath of the bleach-fixing bath or fixing for the purpose of reducing the amount of the waste liquid.

In the present photographic process, the replenisher of each processing solution is used in the continuous procedure so that variations in the composition of each processing solution used can be prevented, and thus, photographic products having a consistently finished state can be obtained. The amount of the replenisher may be reduced to one-half or less of the standard amount for the purpose of reducing the cost thereof.

Each processing bath may be provided with a heater, a temperature sensor, a liquid surface level sensor, a circulation pump, a filter, a variety of floating lids, a variety of squeegees, a nitrogen stirrer, an air stirrer, etc., if desired.

The process of the present invention can be applied to any color photographic development process which employs a bleaching solution. For instance the present process can be applied to the processing of color papers, color reversal papers, color positive films, color negative films, color reversal films, etc.

The following examples are intended to illustrate the present invention but are not to be construed as limiting the scope of the present invention in any manner. Unless otherwise indicated, all parts, percents, ratios and the like are by weight.

EXAMPLE 1

A sliver halide emulsion (1) used in this example of the present invention was prepared as follows:

| | |
|---|---|
| (Solution-1) | |
| $H_2O$ | 100 cc |
| NaCl | 5.5 g |
| Gelatin | 32 g |
| (Solution-2) | |
| Sulfuric acid (1N) | 24 cc |

-continued

| | |
|---|---|
| (Solution-3) | |
| The following silver halide solvent (1 wt %): | 3 cc |

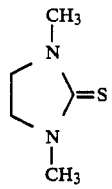

| | |
|---|---|
| (Solution-4) | |
| KBr | 15.66 g |
| NaCl | 3.30 g |
| $H_2O$ to make | 200 cc |
| (Solution-5) | |
| $AgNO_3$ | 32 g |
| $H_2O$ to make | 200 cc |
| (Solution-6) | |
| KBr | 62.62 g |
| NaCl | 13.22 g |
| $K_2IrCl_6$ (0.001 wt %) | 4.54 cc |
| $H_2O$ to make | 600 cc |
| (Solution-7) | |
| $AgNO_3$ | 128 g |
| $H_2O$ to make | 600 cc |

(Solution-1) was heated at 56° C., and (Solution-2) and (Solution-3) were added thereto. Afterwards, (Solution-4) and (Solution-5) were added thereto at the same time over the course of 30 minutes. After 10 minutes, (Solution-6) and (Solution-7) were added at the same time over the course of 20 minutes. After 5 minutes from this last addition, the temperature was lowered and the resulting mixture was subjected to demineralization. Water and gelatin dispersion were added to the mixture, which was thereafter adjusted to have a pH of 6.2, to obtain a monodispersed cubic silver chlorobromide emulsion having an average grain size of 0.45 μm, a variation coefficient (which is the value of the standard deviation as divided by the average grain size: $s/\bar{d}$) of 0.08 and a silver bromide content of 70 mol%. $1.0\times10^{-4}$ mol/mol (Ag) of chloroauric acid was added to this emulsion and then sodium thiosulfate was added thereto, for optimum chemical sensitization of the emulsion.

Next, other silver halide emulsions (2), (3), (4), (5) and (6) each having a different silver chloride content were prepared in the same manner as above, except that the amount (in grams) of KBr and NaCl in the above-mentioned (Solution-4) and (Solution-6) and the time of the addition of (Solution-4) and (Solution-5) were varied as shown in the following Table 1.

TABLE 1

| | (Solution-4) | | (Solution-6) | | Time of Adding (Solution-4) and |
|---|---|---|---|---|---|
| Emulsion | KBr | NaCl | KBr | NaCl | (Solution-5) |
| (2) | 6.71 g | 7.70 g | 26.88 g | 30.84 g | 12 minutes |
| (3) | 3.36 g | 9.35 g | 13.44 g | 37.44 g | 10 minutes |
| (4) | 1.12 g | 10.45 g | 4.48 g | 41.85 g | 9 minutes |
| (5) | 0.22 g | 10.89 g | 0.90 g | 43.61 g | 8 minutes |
| (6) | 0.00 g | 11.00 g | 0.00 g | 44.05 g | 8 minutes |

The average grain size, the variation coefficient and the halogen composition of the silver halide emulsions (1) to (6) are set forth in the following Table 2.

TABLE 2

| Emulsion | Average Grain Size (μm) | Variation Coefficient (s/d) | Halogen Composition (%) Br | Cl |
|---|---|---|---|---|
| (1) | 0.45 | 0.08 | 70 | 30 |
| (2) | 0.45 | 0.07 | 30 | 70 |
| (3) | 0.45 | 0.07 | 15 | 85 |
| (4) | 0.45 | 0.08 | 5 | 95 |
| (5) | 0.45 | 0.08 | 1 | 99 |
| (6) | 0.45 | 0.08 | 0 | 100 |

Next, 11.5 ml of ethyl acetate and 7.7 ml of the solvent (c) were added to 10.0 g of the cyan coupler (a) and 5.6 g of the color image stabilizer (b) and dissolved, and the rsulting solution was dispersed by emulsification in 150 ml of an aqueous 10 wt% gelatin solution containing 10 ml of 10 wt% sodium dodecylbenzenesulfonate.

The compounds shown in the following Table 3 were added to each of the previously prepared emulsions (1) to (6), and the resulting mixture was combined with the emulsified dispersion prepared above, to obtain the samples shown in Table 3. In addition, the compounds shown in the following Table 4 were added to each of the previously prepared emulsions and the resulting mixture was combined with the emulsified dispersion prepared above, to obtain the samples shown in Table 4.

A polyethylene laminate-duplicated paper support was used for each sample. The amount of the solution to be coated was regulated so that the amount of silver was 0.35 g/m$^2$, the amount of the coupler was 0.45 g/m$^2$ and the amount of gelatin was 1.50 g/m$^2$, and a protective layer containing 1.50 g/m$^2$ of gelatin was provided as an uppermost layer. In addition, sodium 1-hydroxy-3,5-dichloro-s-triazine was used in each layer as a gelatin hardener.

Cyan Coupler (a):

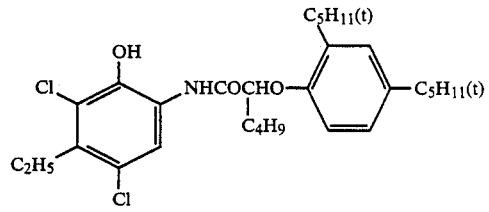

Color Image Stabilizer (b): 1/3/3 (by molar ratio) mixture of the following compounds

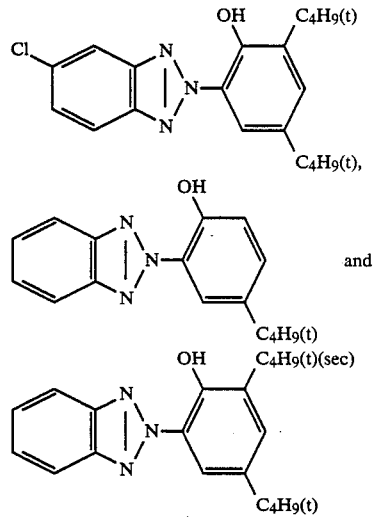

Solvent (c):

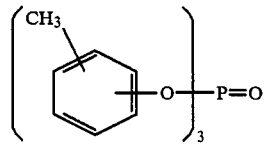

Antifoggant (d):

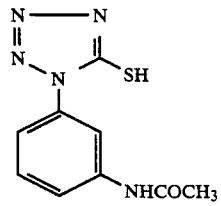

Antifoggant (e):

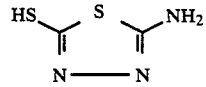

-continued

Antifoggant (f):

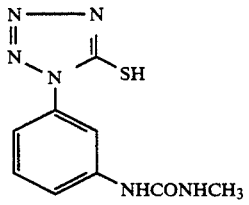

TABLE 3

| Sample No. | Emulsion No. | Kind | Amount (mol/mol AgX) |
|---|---|---|---|
| 1-1 | (1) | (A)* | $1.0 \times 10^{-4}$ |
| 1-2 | (2) | " | " |
| 1-3 | (3) | " | " |
| 1-4 | (4) | " | " |
| 1-5 | (5) | " | " |
| 1-6 | (6) | " | " |
| 1-7 | (1) | I-4 | $7.0 \times 10^{-5}$ |
| 1-8 | (2) | " | " |
| 1-9 | (3) | " | " |
| 1-10 | (4) | " | " |
| 1-11 | (5) | " | " |
| 1-12 | (6) | " | " |
| 1-13 | (1) | I-5 | $7.0 \times 10^{-5}$ |
| 1-14 | (3) | " | " |
| 1-15 | (4) | " | " |
| 1-16 | (5) | " | " |
| 1-17 | (4) | II-2 | $7.0 \times 10^{-5}$ |
| 1-18 | (5) | " | " |
| 1-19 | (4) | I-17 | $6.0 \times 10^{-5}$ |
| 1-20 | (6) | " | " |
| 1-21 | (3) | I-19 | $7.0 \times 10^{-5}$ |
| 1-22 | (4) | " | " |
| 1-23 | (5) | " | " |
| 1-24 | (6) | " | " |
| 1-25 | (1) | (B) | $6.0 \times 10^{-5}$ |
| 1-26 | (3) | " | " |
| 1-27 | (4) | " | " |
| 1-28 | (6) | " | " |
| 1-29 | (1) | III-2 | $6.0 \times 10^{-5}$ |

TABLE 3-continued

| Sample No. | Emulsion No. | Kind | Amount (mol/mol AgX) |
|---|---|---|---|
| 1-30 | (3) | " | " |
| 1-31 | (4) | " | " |
| 1-32 | (6) | " | " |
| 1-33 | (3) | III-17 | $5.5 \times 10^{-5}$ |
| 1-34 | (4) | " | " |
| 1-35 | (5) | " | " |
| 1-36 | (6) | " | " |

*Comparative compounds (A) and (B) are shown hereafter.

Comparative Compound (A):

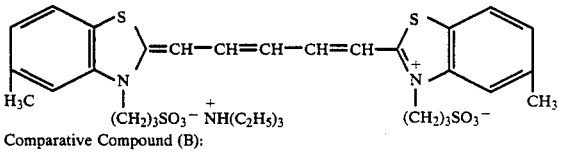

Comparative Compound (B):

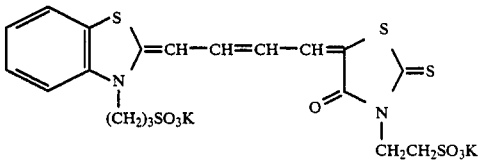

TABLE 4

| Sample No. | Emulsion No. | Compound Added Kind | Compound Added Amount (mol/mol AgX) | Compound Added Kind | Compound Added Amount (mol/mol AgX) | Compound Added Kind | Compound Added Amount (mol/mol AgX) | Amount of KBr (mol/mol AgX) |
|---|---|---|---|---|---|---|---|---|
| 2-1a | (3) | I-19 | $7.0 \times 10^{-5}$ | — | — | — | — | — |
| 2-1b | (3) | " | " | IV-21 | $4.0 \times 10^{-4}$ | — | — | — |
| 2-2a | (5) | " | " | — | — | (d) | $5.0 \times 10^{-4}$ | — |
| 2-2b | (5) | " | " | IV-21 | $4.0 \times 10^{-4}$ | " | " | — |
| 2-3a | (6) | " | " | — | — | (f) | " | — |
| 2-3b | (6) | " | " | IV-21 | $4.0 \times 10^{-4}$ | " | " | — |
| 2-4a | (4) | I-8 | $7.0 \times 10^{-5}$ | — | — | — | — | — |
| 2-4b | (4) | " | " | IV-21 | $1.0 \times 10^{-4}$ | — | — | — |
| 2-5a | (5) | " | " | — | — | — | — | $3.0 \times 10^{-3}$ |
| 2-5b | (5) | " | " | IV-21 | $1.0 \times 10^{-4}$ | — | — | " |
| 2-6a | (3) | II-2 | $7.5 \times 10^{-5}$ | — | — | (e) | $3.5 \times 10^{-4}$ | — |
| 2-6b | (3) | " | " | IV-4 | $5.0 \times 10^{-4}$ | " | " | — |
| 2-7a | (5) | " | " | — | — | " | " | $4.0 \times 10^{-3}$ |
| 2-7b | (5) | " | " | IV-4 | $5.0 \times 10^{-4}$ | " | " | — |
| 2-8a | (4) | I-14 | $6.0 \times 10^{-5}$ | — | — | — | — | — |
| 2-8b | (4) | " | " | IV-12 | $5.0 \times 10^{-4}$ | — | — | — |
| 2-9a | (6) | " | " | — | — | — | — | — |
| 2-9b | (6) | " | " | IV-12 | $5.0 \times 10^{-4}$ | — | — | — |
| 2-10a | (5) | I-3 | $7.0 \times 10^{-5}$ | — | — | (d) | $4.0 \times 10^{-4}$ | — |
| 2-10b | (5) | " | " | IV-21 | $4.0 \times 10^{-4}$ | " | " | — |
| 2-11a | (6) | " | " | — | — | " | " | — |
| 2-11b | (6) | " | " | IV-21 | $4.0 \times 10^{-4}$ | " | " | — |
| 2-12a | (3) | III-2 | $6.5 \times 10^{-5}$ | — | — | (f) | $3.5 \times 10^{-4}$ | — |
| 2-12b | (3) | " | " | IV-21 | $3.5 \times 10^{-4}$ | " | " | — |
| 2-13a | (5) | " | " | — | — | " | $4.0 \times 10^{-4}$ | — |
| 2-13b | (5) | " | " | IV-21 | $3.5 \times 10^{-4}$ | " | " | — |
| 2-14a | (4) | III-17 | $5.5 \times 10^{-5}$ | — | — | — | — | $3.0 \times 10^{-3}$ |
| 2-14b | (4) | " | " | IV-12 | $4.0 \times 10^{-4}$ | — | — | " |
| 2-15a | (6) | " | $6.5 \times 10^{-5}$ | — | — | (f) | $4.0 \times 10^{-4}$ | " |
| 2-15b | (6) | " | " | IV-12 | $4.0 \times 10^{-4}$ | " | " | " |

A gradation exposure for sensitometry was imparted to the above-mentioned samples (1-1) through (I-36) and (2-1(a,b)) through (2-15(a, b)) through Sharp Cut Filter No. 60 (manufactured by Fuji Photo Film Co., Ltd.) by the use of a sensitometer (FWH-type, manufactured by Fuji Photo Film Co., Ltd.; Color temperature in light source: 3200° K.). The amount of the exposure was regulated so as to be 250 CMS by exposure for 0.5 second.

Afterwards, experimentation using the following treatments (A) and (B) were carried out, using the color developers (A) and (B) as set forth below.

Such treatment comprises the steps of color development, bleach-fixation and rinsing. The development time was 3 minutes and 30 seconds in treatment (A), which was the standard to confirm the effect of the present invention. In the treatment (B), the development time was varied to be 30 seconds or 60 seconds, and thus, the photographic properties of each sample was evaluated. Each of the specific steps in treatments (A) and (B) are set forth below.

The evaluation of the photographic properties was measured as to fog density (Dmin), the relative sensitivity, the color forming property and the desilvering property, and the results obtained are set forth in the following Tables 5, 6 and 7. The relative sensitivity was measured as follows: The sensitivity was represented by the reciprocal of the exposure necessary for attaining the density which is the fog density plus 0.5. In Table 5, the results of the development of the Sample 1-1 for 3 minutes and 30 seconds by the Treatment (A) is used as the standard sensitivity, and the sensitivity of each of the other samles was measured as a relative value to the standard sensitivity of the Sample 1-1. These values are thus defined as the relative sensitivity. In Table 6, the result of the development of each sample to which the compound represented by general formula (IV) was not added, for 3 minutes and 30 seconds by the Treatment (A) is used as the standard sensitivity, and the sensitivity of each of the other samples was measured as a relative value to this standard sensitivity. These values are thus defined as the relative sensitivity.

With respect to the color forming property, the treatment for 3 minutes and 30 seconds by the Treatment (A) was made the standard so as to evaluate the rapidity of the development. Specifically, the exposure for attaining a color density of 1.50 by the Treatment (A) for 3 minutes and 30 seconds was obtained in each sample, and the color forming property was evaluated on the basis of the color density as attained by this exposure in each treatment.

The desilvering property was evaluated as follows. Specifically, the samples were bleach-fixed in accordance with the following three methods: In the first method, the samples were treated with the bleach-fixation solution (B) (temperature; 35° C., time: 45 seconds) in the Treatment (B), which will be described hereinafter. In the second method, the samples were treated with the same bleach-fixing solution as in the first method, but using a bleach-fixation time of 25 seconds and at the temperature of 35° C. In the third method, the samples were treated with a bleach-fixing solution prepared by adding sodium hydroxide to the bleach-fixing solution used in the first and the second methods so as to adjust the pH value to 7.0, for 45 seconds at 35° C. The four samples thus treated were visually observed and evaluated on the basis of the following four-step evaluation. The evaluation standards were as follows:

1. A large remaining amount of developed silver was noted, and this level is not suitable for practical usage (This level corresponds to a remaining amount of 20% or more of the silver amount as coated).
2. A lesser remaining amount of developed silver was noted by careful visual observation and a color turbidity was slightly noted, and this level is not preferable for practical use.
3. No remaining amount of developed silver was noted even by careful visual observation, and a color turbidity was only slightly noted by careful visual observation in comparison with the colored samples of a level which does not have any problem at all. This level is free from any problems in practical use.
4. No color turbidity was noted. This level also does not have any problems at all in practical use.

Treatments (A) and (B) employed the following processing steps:

| Processing Step: | Temperature: | Time: |
|---|---|---|
| Development | A: 33° C. | 3 min 30 sec |
| | B: 35° C. | from 30 sec to 60 sec |
| Bleach-fixation | A: 33° C. | 1 min 30 sec |
| | B: 35° C. | 45 sec |
| Rinsing | from 28 to 35° C. | 1 min 30 sec |

The developers used had the following composition:

| | |
|---|---|
| Color Developer (A): | |
| 5Na—Diethylenetriamine-pentaacetate | 2.0 g |
| Benzyl alcohol | 15 ml |
| Diethylene glycol | 10 ml |
| $Na_2SO_3$ | 2.0 g |
| KBr | 1.0 g |
| Hydroxylamine sulfate | 3.0 g |
| 4-Amino-3-methyl-N—ethyl-β-(methanesulfonamido)ethyl]-p-phenylenediamine/sulfate | 5.0 g |
| $N_2CO_3$ (mono-hydrate) | 30.0 g |
| 4,4'-Diaminostilbene-type brightening agent (Whitex, manufactured by Sumitomo Chemical Co.) | 1.0 g |
| Water to make | 1000 ml (pH 10.2) |
| Color Developer (B): | |
| Water | 800 cc |
| Diethylenetriamine-pentaacetic acid | 1.0 g |
| Sodium Sulfite | 0.2 g |
| N,N—Diethylhydroxylamine | 4.2 g |
| Potassium bromide | 0.01 g |
| Sodium chloride | 1.5 g |
| Triethanolamine | 8.0 g |
| Potassium carbonate | 30 g |
| N—Ethyl-N—β-methanesulfonamidoethyl)-3-methyl-4-aminoaniline/sulfate | 4.5 g |
| 4,4'-Diaminostilbene-type brightening agent (Whitex 4, manufactured by Sumitomo Chemical Co.) | 2.0 g |
| Water to make | 1000 cc |
| KOH to make | pH 10.25 |

The composition of the other processing solutions was as follows:

| | |
|---|---|
| Bleaching-fixation Solution: | |
| Ammonium thiosulfate (54 wt %) | 150 ml |
| $Na_2SO_3$ | 15 g |
| $NH_4[Fe(III)(EDTA)]$ | 55 g |
| EDTA.2Na | 4 g |
| Glacial acetic acid | 8.61 g |
| Water to make | 1000 ml (pH 5.4) |
| Rinsing Solution: | |
| $EDTA.2Na.2H_2O$ | 0.4 g |

-continued

TABLE 5

| Water to make | 1000 ml (pH 7.0) | Treatment (A) | | | | Treatment (B) | | | |
|---|---|---|---|---|---|---|---|---|---|
| Sample No. | Development Time | Dmin | Relative Sensitivity | Color Forming Property | Development Time | Dmin | Relative Sensitivity | Color Forming Property |
| 1-1 | 3 min 30 sec | 0.09 | 100 (Standarad) | 1.5 | 30 sec. | 0.08 | 68 | 1.11 |
| | | | | | 60 sec. | 0.09 | 93 | 1.40 |
| 1-2 | " | 0.09 | 91 | " | 30 sec. | 0.09 | 65 | 1.17 |
| | | | | | 60 sec. | 0.09 | 86 | 1.42 |
| 1-3 | " | 0.10 | 71 | " | 30 sec. | 0.10 | 54 | 1.24 |
| | | | | | 60 sec. | 0.11 | 70 | 1.48 |
| 1-4 | " | 0.12 | 60 | " | 30 sec. | 0.11 | 51 | 1.34 |
| | | | | | 60 sec. | 0.14 | 63 | 1.53 |
| 1-5 | " | 0.15 | 48 | " | 30 sec. | 0.13 | 47 | 1.47 |
| | | | | | 60 sec. | 0.16 | 50 | 1.58 |
| 1-6 | " | 0.17 | 44 | " | 30 sec. | 0.15 | 44 | 1.51 |
| | | | | | 60 sec. | 0.18 | 47 | 1.60 |
| 1-7 | " | 0.09 | 295 | " | 30 sec. | 0.08 | 195 | 1.13 |
| | | | | | 60 sec. | 0.09 | 280 | 1.42 |
| 1-8 | " | 0.09 | 289 | " | 30 sec. | 0.08 | 197 | 1.23 |
| | | | | | 60 sec. | 0.09 | 283 | 1.44 |
| 1-9 | " | 0.10 | 280 | " | 30 sec. | 0.10 | 233 | 1.31 |
| | | | | | 60 sec. | 0.10 | 280 | 1.51 |
| 1-10 | " | 0.11 | 263 | " | 30 sec. | 0.11 | 244 | 1.39 |
| | | | | | 60 sec. | 0.11 | 281 | 1.58 |
| 1-11 | " | 0.13 | 251 | " | 30 sec. | 0.12 | 256 | 1.51 |
| | | | | | 60 sec. | 0.13 | 288 | 1.63 |
| 1-12 | " | 0.15 | 251 | " | 30 sec. | 0.13 | 260 | 1.54 |
| | | | | | 60 sec. | 0.15 | 294 | 1.66 |
| 1-13 | " | 0.09 | 363 | " | 30 sec. | 0.08 | 240 | 1.15 |
| | | | | | 60 sec. | 0.09 | 345 | 1.43 |
| 1-14 | " | 0.10 | 345 | " | 30 sec. | 0.10 | 286 | 1.39 |
| | | | | | 60 sec. | 0.10 | 352 | 1.55 |
| 1-15 | " | 0.12 | 338 | " | 30 sec. | 0.11 | 314 | 1.54 |
| | | | | | 60 sec. | 0.11 | 361 | 1.68 |
| 1-16 | " | 0.15 | 315 | " | 30 sec. | 0.13 | 322 | 1.58 |
| | | | | | 60 sec. | 0.15 | 363 | 1.72 |
| 1-17 | " | 0.14 | 158 | " | 30 sec. | 0.12 | 147 | 1.40 |
| | | | | | 60 sec. | 0.14 | 169 | 1.57 |
| 1-18 | " | 0.16 | 147 | " | 30 sec. | 0.14 | 146 | 1.51 |
| | | | | | 60 sec. | 0.16 | 165 | 1.64 |
| 1-19 | " | 0.11 | 245 | " | 30 sec. | 0.10 | 228 | 1.44 |
| | | | | | 60 sec. | 0.11 | 262 | 1.60 |
| 1-20 | " | 0.15 | 224 | " | 30 sec. | 0.13 | 233 | 1.57 |
| | | | | | 60 sec. | 0.16 | 251 | 1.69 |
| 1-21 | " | 0.10 | 288 | " | 30 sec. | 0.10 | 244 | 1.38 |
| | | | | | 60 sec. | 0.11 | 294 | 1.54 |
| 1-22 | " | 0.11 | 276 | " | 30 sec. | 0.10 | 257 | 1.52 |
| | | | | | 60 sec. | 0.11 | 295 | 1.67 |
| 1-23 | " | 0.14 | 270 | " | 30 sec. | 0.12 | 284 | 1.57 |
| | | | | | 60 sec. | 0.14 | 316 | 1.71 |
| 1-24 | " | 0.16 | 270 | " | 30 sec. | 0.15 | 289 | 1.60 |
| | | | | | 60 sec. | 0.16 | 316 | 1.73 |
| 1-25 | " | 0.10 | 83 | " | 30 sec. | 0.10 | 56 | 1.13 |
| | | | | | 60 sec. | 0.10 | 77 | 1.41 |
| 1-26 | " | 0.12 | 74 | " | 30 sec. | 0.11 | 53 | 1.26 |
| | | | | | 60 sec. | 0.12 | 70 | 1.48 |
| 1-27 | " | 0.15 | 70 | " | 30 sec. | 0.14 | 60 | 1.35 |
| | | | | | 60 sec. | 0.16 | 71 | 1.52 |
| 1-28 | " | 0.18 | 64 | " | 30 sec. | 0.17 | 63 | 1.49 |
| | | | | | 60 sec. | 0.20 | 67 | 1.59 |
| 1-29 | " | 0.09 | 223 | " | 30 sec. | 0.09 | 151 | 1.15 |
| | | | | | 60 sec. | 0.09 | 212 | 1.42 |
| 1-30 | " | 0.10 | 213 | " | 30 sec. | 0.10 | 151 | 1.33 |
| | | | | | 60 sec. | 0.10 | 208 | 1.50 |
| 1-31 | " | 0.12 | 204 | " | 30 sec. | 0.11 | 169 | 1.41 |
| | | | | | 60 sec. | 0.12 | 208 | 1.57 |
| 1-32 | " | 0.15 | 195 | " | 30 sec. | 0.13 | 204 | 1.57 |
| | | | | | 60 sec. | 0.15 | 224 | 1.68 |
| 1-33 | " | 0.09 | 194 | " | 30 sec. | 0.09 | 161 | 1.34 |
| | | | | | 60 sec. | 0.09 | 198 | 1.51 |
| 1-34 | " | 0.11 | 185 | " | 30 sec. | 0.11 | 172 | 1.40 |
| | | | | | 60 sec. | 0.12 | 194 | 1.57 |
| 1-35 | " | 0.14 | 181 | " | 30 sec. | 0.13 | 181 | 1.52 |
| | | | | | 60 sec. | 0.15 | 194 | 1.64 |
| 1-36 | " | 0.15 | 178 | " | 30 sec. | 0.14 | 182 | 1.57 |
| | | | | | 60 sec. | 0.17 | 196 | 1.69 |

TABLE 6

| Sample No. | Treatment (A) Development Time | Dmin | Relative Sensitivity | Color Forming Property | Treatment (B) Development Time | Dmin | Relative Sensitivity | Color Forming Property |
|---|---|---|---|---|---|---|---|---|
| 2-1a | 3 min 30 sec | 0.10 | 100 | 1.5 | 30 sec. | 0.10 | 85 | 1.38 |
| | | | (Standard) | | 60 sec. | 0.11 | 102 | 1.54 |
| 2-1b | " | 0.10 | 316 | " | 30 sec. | 0.10 | 256 | 1.36 |
| | | | | | 60 sec. | 0.10 | 316 | 1.52 |
| 2-2a | " | 0.12 | 100 | " | 30 sec. | 0.11 | 105 | 1.55 |
| | | | (Standard) | | 60 sec. | 0.12 | 117 | 1.70 |
| 2-2b | " | 0.12 | 302 | " | 30 sec. | 0.12 | 308 | 1.54 |
| | | | | | 60 sec. | 0.13 | 347 | 1.68 |
| 2-3a | " | 0.13 | 100 | " | 30 sec. | 0.12 | 107 | 1.62 |
| | | | (Standard) | | 60 sec. | 0.13 | 117 | 1.75 |
| 2-3b | " | 0.13 | 288 | " | 30 sec. | 0.12 | 308 | 1.60 |
| | | | | | 60 sec. | 0.13 | 331 | 1.73 |
| 2-4a | " | 0.12 | 100 | " | 30 sec. | 0.11 | 93 | 1.52 |
| | | | (Standard) | | 60 sec. | 0.12 | 107 | 1.67 |
| 2-4b | " | 0.12 | 178 | " | 30 sec. | 0.11 | 169 | 1.54 |
| | | | | | 60 sec. | 0.12 | 196 | 1.68 |
| 2-5a | " | 0.13 | 100 | " | 30 sec. | 0.11 | 102 | 1.57 |
| | | | (Standard) | | 60 sec. | 0.13 | 115 | 1.70 |
| 2-5b | " | 0.13 | 178 | " | 30 sec. | 0.11 | 182 | 1.59 |
| | | | | | 60 sec. | 0.13 | 205 | 1.71 |
| 2-6a | " | 0.10 | 100 | 1.50 | 30 sec. | 0.10 | 93 | 1.32 |
| | | | (Standard) | | 60 sec. | 0.10 | 107 | 1.50 |
| 2-6b | " | 0.10 | 209 | " | 30 sec. | 0.09 | 199 | 1.30 |
| | | | | | 60 sec. | 0.10 | 224 | 1.51 |
| 2-7a | " | 0.12 | 100 | " | 30 sec. | 0.10 | 99 | 1.50 |
| | | | (Standard) | | 60 sec. | 0.11 | 112 | 1.62 |
| 2-7b | " | 0.12 | 200 | " | 30 sec. | 0.10 | 200 | 1.52 |
| | | | | | 60 sec. | 0.11 | 224 | 1.64 |
| 2-8a | " | 0.11 | 100 | " | 30 sec. | 0.11 | 93 | 1.41 |
| | | | (Standard) | | 60 sec. | 0.11 | 107 | 1.58 |
| 2-8b | " | 0.11 | 282 | " | 30 sec. | 0.10 | 262 | 1.41 |
| | | | | | 60 sec. | 0.11 | 301 | 1.57 |
| 2-9a | " | 0.15 | 100 | " | 30 sec. | 0.13 | 104 | 1.56 |
| | | | (Standard) | | 60 sec. | 0.15 | 112 | 1.68 |
| 2-9b | " | 0.15 | 295 | " | 30 sec. | 0.13 | 310 | 1.57 |
| | | | | | 60 sec. | 0.15 | 339 | 1.71 |
| 2-10a | " | 0.13 | 100 | " | 30 sec. | 0.11 | 102 | 1.53 |
| | | | (Standard) | | 60 sec. | 0.12 | 115 | 1.66 |
| 2-10b | " | 0.12 | 288 | " | 30 sec. | 0.12 | 294 | 1.52 |
| | | | | | 60 sec. | 0.12 | 331 | 1.67 |
| 2-11a | " | 0.14 | 100 | " | 30 sec. | 0.12 | 104 | 1.55 |
| | | | (Standard) | | 60 sec. | 0.14 | 117 | 1.68 |
| 2-11b | " | 0.14 | 263 | " | 30 sec. | 0.12 | 289 | 1.56 |
| | | | | | 60 sec. | 0.14 | 316 | 1.71 |
| 2-12a | " | 0.10 | 100 | " | 30 sec. | 0.09 | 71 | 1.30 |
| | | | (Standard) | | 60 sec. | 0.10 | 98 | 1.47 |
| 2-12b | " | 0.10 | 331 | " | 30 sec. | 0.10 | 251 | 1.32 |
| | | | | | 60 sec. | 0.10 | 331 | 1.46 |
| 2-13a | " | 0.12 | 100 | " | 30 sec. | 0.12 | 105 | 1.44 |
| | | | (Standard) | | 60 sec. | 0.13 | 115 | 1.62 |
| 2-13b | " | 0.12 | 302 | " | 30 sec. | 0.12 | 317 | 1.42 |
| | | | | | 60 sec. | 0.13 | 347 | 1.60 |
| 2-14a | " | 0.10 | 100 | " | 30 sec. | 0.10 | 93 | 1.38 |
| | | | (Standard) | | 60 sec. | 0.11 | 105 | 1.53 |
| 2-14b | " | 0.10 | 263 | " | 30 sec. | 0.10 | 250 | 1.38 |
| | | | | | 60 sec. | 0.11 | 268 | 1.54 |
| 2-15a | " | 0.11 | 100 | " | 30 sec. | 0.10 | 102 | 1.53 |
| | | | (Standard) | | 60 sec. | 0.12 | 110 | 1.66 |
| 2-15b | " | 0.11 | 240 | " | 30 sec. | 0.10 | 257 | 1.58 |
| | | | | | 60 sec. | 0.12 | 276 | 1.70 |

TABLE 7

| Sample No. | Blix-1 (pH 5.4) Development Time (sec.) | Desilvering Property | Blix-2 (pH 7.0) Development Time (sec.) | Desilvering Property |
|---|---|---|---|---|
| 1-1 | 25 | 4 | 25 | 2 |
| | 45 | 4 | 45 | 2 |
| 1-4 | 25 | 3 | 25 | 1 |
| | 45 | 4 | 45 | 2 |
| 1-6 | 25 | 2 | 25 | 1 |
| | 45 | 3 | 45 | 1 |
| 1-7 | 25 | 4 | 25 | 2 |
| | 45 | 4 | 45 | 2 |
| 1-10 | 25 | 4 | 25 | 1 |

TABLE 7-continued

| Sample No. | Blix-1 (pH 5.4) Development Time (sec.) | Desilvering Property | Blix-2 (pH 7.0) Development Time (sec.) | Desilvering Property |
|---|---|---|---|---|
| | 45 | 4 | 45 | 2 |
| 1-12 | 25 | 4 | 25 | 1 |
| | 45 | 4 | 45 | 2 |
| 1-14 | 25 | 4 | 25 | 1 |
| | 45 | 4 | 45 | 2 |
| 1-16 | 25 | 3 | 25 | 1 |
| | 45 | 4 | 45 | 1 |
| 1-19 | 25 | 4 | 25 | 1 |
| | 45 | 4 | 45 | 2 |

TABLE 7-continued

| Sample No. | Blix-1 (pH 5.4) Development Time (sec.) | Blix-1 (pH 5.4) Desilvering Property | Blix-2 (pH 7.0) Development Time (sec.) | Blix-2 (pH 7.0) Desilvering Property |
|---|---|---|---|---|
| 1-20 | 25 | 4 | 25 | 1 |
| | 45 | 4 | 45 | 2 |
| 1-21 | 25 | 4 | 25 | 1 |
| | 45 | 4 | 45 | 2 |
| 1-23 | 25 | 4 | 25 | 1 |
| | 45 | 4 | 45 | 1 |
| 1-25 | 25 | 4 | 25 | 2 |
| | 45 | 4 | 45 | 2 |
| 1-27 | 25 | 3 | 25 | 1 |
| | 45 | 3 | 45 | 2 |
| 1-28 | 25 | 2 | 25 | 1 |
| | 45 | 3 | 45 | 1 |
| 1-30 | 25 | 4 | 25 | 1 |
| | 45 | 4 | 45 | 2 |
| 1-32 | 25 | 3 | 25 | 1 |
| | 45 | 4 | 45 | 1 |
| 2-2a | 25 | 4 | 25 | 1 |
| | 45 | 4 | 45 | 1 |
| 2-2b | 25 | 4 | 25 | 1 |
| | 45 | 4 | 45 | 1 |
| 2-5a | 25 | 4 | 25 | 1 |
| | 45 | 4 | 45 | 2 |
| 2-5b | 25 | 4 | 25 | 1 |
| | 45 | 4 | 45 | 1 |
| 2-10b | 25 | 4 | 25 | 1 |
| | 45 | 4 | 45 | 2 |
| 2-12b | 25 | 4 | 25 | 1 |
| | 45 | 4 | 45 | 2 |
| 2-14b | 25 | 3 | 25 | 1 |
| | 45 | 3 | 45 | 1 |

The results in Tables 5 and 6 demonstrate that in accordance with the present invention, a high spectral sensitivity can be obtained even when a high silver chloride emulsion is used, and in addition, a high spectral sensitivity and a high color density can also be obtained even when using rapid treatment with a color developer containing no benzyl alcohol. On the other hand, comparative compounds (A) and (B) have heretofore been considered to be effective even in a high silver chloride emulsion. However, when these comparative compounds were used in the high silver chloride emulsion of the present invention in the above-shown example, the spectral sensitivity was actually lower than that attainable where the comparative compounds are used in an emulsion mainly comprising silver bromide. Thus, the compounds which have heretofore been considered effective and actually used in emulsions mainly comprising silver bromide cannot always be used in high silver chloride emulsions, and only the specific compound described above for use in the present invention and which have the specific constitution as restricted by the present invention are effective in high silver chloride emulsions.

In addition, it is clear that the use of a slight amount of potassium bromide or the above-mentioned mercapto-containing heterocyclic compound together with the compounds of the present invention does not cause any adverse influences on the spectral sensitivity and the rapid processability but rather is effective for reducing the formation of fog. With respect to sensitivity, an increase was also noted in some cases.

The compounds of the general formula (IV) are ones which have heretofore been known to be effective for the supersensitization of an emulsion mainly comprising silver bromide. As is apparent from the results shown in Table 6, however, these compounds were effective for attaining a remarkable supersensitization effect and excellent color forming properties even when they were used in a high silver chloride emulsions and when the emulsion-containing photographic material was rapidly treated with a color developer in accordance with the present invention. In addition, as is apparent from the results shown in Table 7, the desilvering property was also good under the bleach-fixation condition of the present invention. Regarding the desilvering property, this property is apt to deteriorate with an increase in the content of silver chloride in the emulsion, as mentioned above. In particular, the silver halide emulsions having such a high silver chloride content that can facilitate color development with a short period of time, as in the present invention, would often have a poor desilvering property. However, the present invention has succeeded in attaining the above-shown excellent desilvering property because of the combined use of the compounds of the present invention, which have the specific chemical structure described above, together with high silver chloride emulsions and by the rapid treatment with the specific bleach-fixation solution of the present invention for a short period of time. Even when compounds other than the specific compounds of the present invention are used (such as comparative compounds (A) and (B), which are known to have an excellent activity for spectral sensitization of an emulsion mainly comprising silver bromide, such high silver bromide emulsions being outside the scope of the present invention), in the high silver chloride emulsions of the present invention, it is concluded from the results of the above example that a high degree of sensitivity cannot be obtained, and also a good desilvering property cannot be attained even by the use of the bleach-fixation solution of the present invention. The reason for this phenomenon is considered to be that the compounds other than the specific compounds of the present invention would disturb the bleaching of the developed silver during the bleach-fixation procedure.

In light of the foregoing, it would be understood that only the compounds of the present invention, which have the specific structure described above, are effective for attaining high sensitivity even in the high silver chloride emulsions and that the rapid bleaching of the photographic materials comprising high silver chloride emulsions with these specific compounds is possible only under the specific conditions defined by the present invention.

The value of the present invention is extremely high, since the present invention provides silver halide color photographic materials which have a high sensitivity and which can be processed by a rapid development treatment.

EXAMPLE 2

A silver halide emulsion (7) as used in this example was prepared as follows:

| | |
|---|---|
| (Solution-8) | |
| $H_2O$ | 1000 cc |
| NaCl | 5.5 g |
| Gelatin | 32 g |
| (Solution-9) | |
| Sulfuric acid (1N) | 20 cc |
| (Solution-10) | |
| The following silver halide solvent (1 wt %): | 3 cc |

-continued

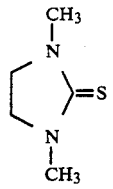

(Solution-11)

| | |
|---|---|
| KBr | 2.45 g |
| NaCl | 0.52 g |
| $H_2O$ to make | 140 cc |
| (Solution-12) | |
| $AgNO_3$ | 5 g |
| $H_2O$ to make | 140 cc |
| (Solution-13) | |
| KBr | 59.80 g |
| NaCl | 12.39 g |
| $K_2IrCl_6$ (0.001 wt %) | 0.7 cc |
| $H_2O$ to make | 320 cc |
| (Solution-14) | |
| $AgNO_3$ | 120 g |
| $H_2O$ to make | 320 cc |

(Solution-8) was heated at 75° C., and (Solution-9) and (Solution-10) were then added thereto. Afterwards, (Solution-11) and (Solution-12) were added thereto at the same time over the course of 9 minutes. Further, after 10 minutes, (Solution-13) and (Solution-14) were added at the same time over the course of 45 minutes. After 5 minutes from this last addition, the temperature was lowered and the resulting mixture was subjected to demineralization. Water and gelatin were added to the mixture, which was thereafter adjusted to have a pH of 6.2, to obtain a monodispersed cubic silver chlorobromide emulsion having an average grain size of 1.01 μm, a variation coefficient (which is the value of the standard deviation as divided by the average grain size: s/d) of 0.08 and a silver bromide content of 70 mol%. To this emulsion, sodium thiosulfate was added for optimum chemical sensitization.

Next, other silver halide emulsions (8) and (9) each having a different silver chloride content were prepared in the same manner as above, except that the liquid temperature of the (Solution-8) was vaired to 62° C. and the composition of each of (Solution-11) through (Solution-14) and the addition time of (Solution-11) and (Solution-12) and that of (Solution-13) and (Solution-14) were varied as shown in the following Tables 8 and 9.

TABLE 8

| | Solution-11 | | | Solution-12 | | | Addition Time of |
|---|---|---|---|---|---|---|---|
| Emulsion | KBr | NaCl | $H_2O$ to make | $AgNO_3$ | $NH_4NO_3$ (50%) | $H_2O$ to make | Solution-11 and Solution-12 |
| (8) | 2.63 g | 7.31 g | 130 cc | 25 g | 0.5 cc | 130 cc | 60 minutes |
| (9) | 0.18 g | 8.51 g | 130 cc | 25 g | 0.5 cc | 130 cc | 60 minutes |

TABLE 9

| | Solution-13 | | | | Solution-14 | | | Addition Time of |
|---|---|---|---|---|---|---|---|---|
| Emulsion | KBr | NaCl | $K_2IrCl$ (0.001%) | $H_2O$ to make | $AgNO_3$ | $NH_4NO_3$ (50%) | $H_2O$ to make | Solution-13 and Solution-14 |
| (8) | 10.51 g | 29.24 g | 0.7 cc | 285 cc | 100 g | 2.0 cc | 285 cc | 25 minutes |
| (9) | 0.70 g | 34.06 g | 0.7 cc | 285 cc | 100 g | 2.0 cc | 285 cc | 25 minutes |

The average grain size, the variation coefficient and the halogen composition of the silver halide emulsions (7) through (9) are set forth in the following Table 10.

TABLE 10

| Emulsion | Average Grain Size (μm) | Variation Coefficient (s/d) | Halogen Composition (%) Br | Cl |
|---|---|---|---|---|
| (7) | 1.01 | 0.08 | 70 | 30 |
| (8) | 1.01 | 0.07 | 15 | 85 |
| (9) | 1.02 | 0.08 | 1 | 99 |

In the same manner as Example 1, the silver halide emulsions (1), (3), (5), (7), (8) and (9) were each combined with an emulsified dispersion of the color coupler shown below and the compound of the present invention, to obtain the samples (3-1) through (3-6) as set forth below.

In this preparation, the sensitizer dye (l) was added to the emulsion for the blue-sensitive layer in an amount of $7.0\times10^{-4}$ mol per mol of the silver halide; and the sensitizer dye (t) was added to the emulsion for the green-sensitive layer in an amount of $4.0\times10^{31\,4}$ mol per mol of the silver halide.

The following compounds were used as the anti-irradiation dye in each layer. As the gelatin-hardener in each layer, the same compound as Example 1 was used.

Anti-irradiation dye (g) for Green-Sensitive Emulsion Layer:

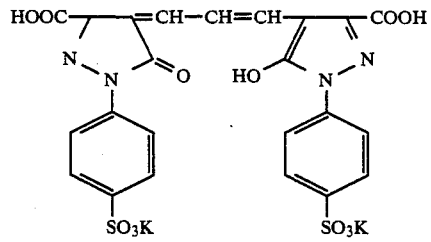

-continued
Anti-irradiation dye (h) for Red-Sensitive Emulsion Layer:
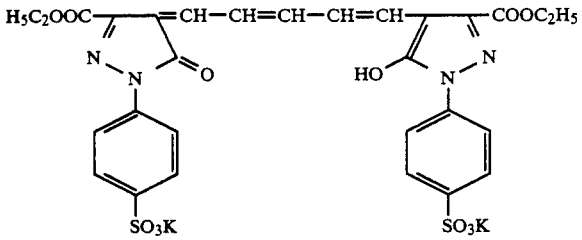
Yellow Coupler (i):
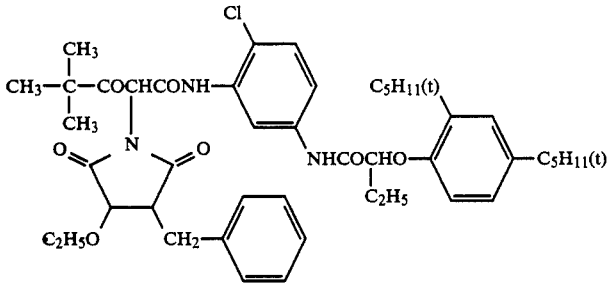
Color Image Stabilizer (j):
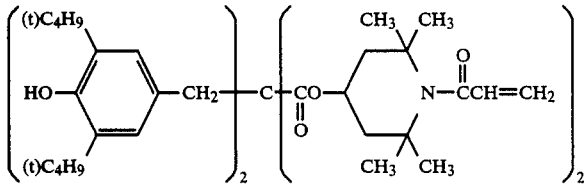
Solvent (k):
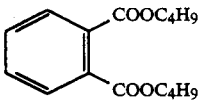
Sensitizing Dye (l):
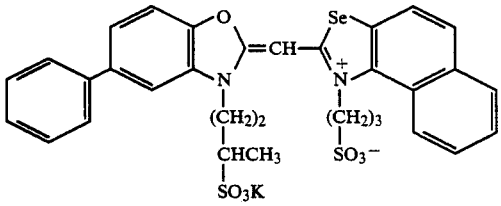
Color Mixing Preventing Agent (m):
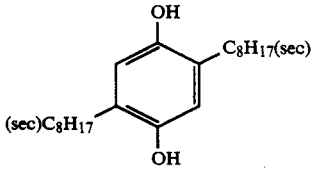
Magenta Coupler (n):

-continued
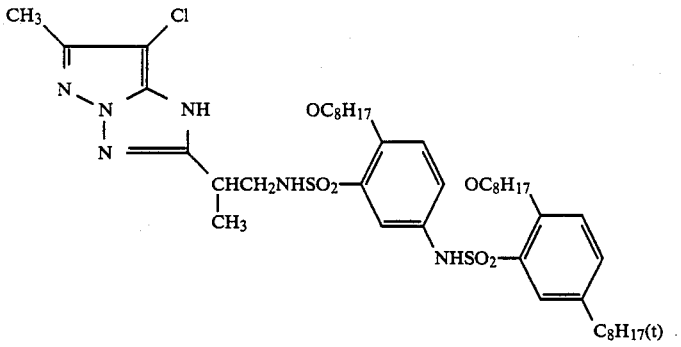
Color Image Stabilizer (o):
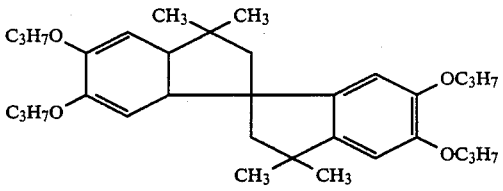
Solvent (p):
2/1 (by weight) mixture of the following compounds
$(C_8H_{17}O)_3P{=}O$ and 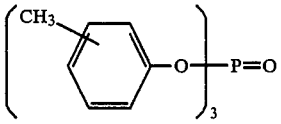
UV-Absorbent (g):
1/5/3 (by molar ratio) mixture of the following compounds
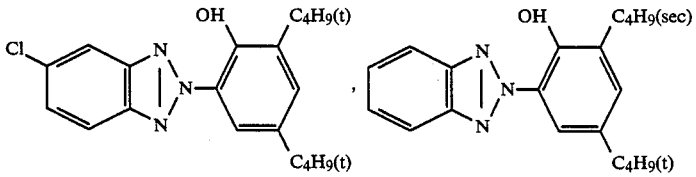
and
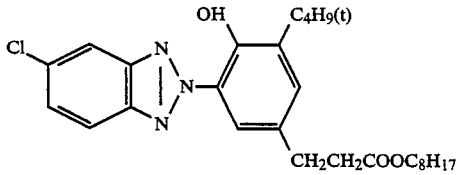
Color Mixing Preventing Agent (r):
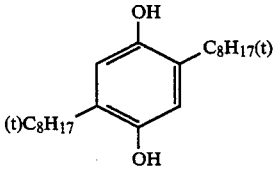
Solvent (s): $(isoC_9H_{18}O)_3P{=}O$
Sensitizing Dye (t):

-continued

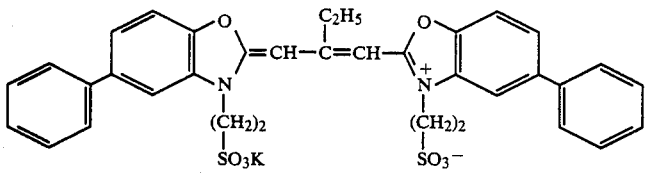

The main composition of each layer was as follows:

Support:

Polyethylene Laminate Paper Support (containing a white pigment of $TiO_2$ and a blueish dye of ultramarine in the polyethylene as coated on the side of the first layer).

| | |
|---|---|
| **First Layer: Blue-Sensitive Emulsion Layer** | |
| Silver Chlorobromide Emulsion (See Table 11) | 0.27 g (Ag)/$m^2$ |
| Gelatin | 1.86 g/$m^2$ |
| Yellow Coupler (i) | 0.71 g/$m^2$ |
| Color Image Stabilizer (j) | 0.19 g/$m^2$ |
| Solvent (k) | 0.34 cc/$m^2$ |
| **Second Layer: Color Mixing Preventing Layer** | |
| Gelatin | 0.99 g/$m^2$ |
| Color Mixing Preventing Agent (m) | 0.08 g/$m^2$ |
| **Third Layer: Green-Sensitive Emulsion Layer** | |
| Silver Chlorobromide Emulsion (See Table 11) | 0.13 g (Ag)/$m^2$ |
| Gelatin | 1.80 g/$m^2$ |
| Magenta Coupler (n) | 0.30 g/$m^2$ |
| Color Image Stabilizer (o) | 0.20 g/$m^2$ |
| Solvent (p) | 0.68 cc/$m^2$ |
| **Fourth Layer: UV-Absorbent Layer** | |
| Gelatin | 1.60 g/$m^2$ |
| UV-Absorbent (q) | 0.62 g/$m^2$ |
| Color-Mixing Preventing Agent (r) | 0.05 g/$m^2$ |
| Solvent (s) | 0.26 cc/$m^2$ |
| **Fifth Layer: Red-Sensitive Emulsion Layer** | |
| Silver Chlorobromide Emulsion (See Table 12) | 0.23 g (Ag)/$m^2$ |
| Gelatin | 0.98 g/$m^2$ |
| Cyan Coupler (a) | 0.30 g/$m^2$ |
| Color Image Stabilizer (b) | 0.17 g/$m^2$ |
| Solvent (c) | 0.23 cc/$m^2$ |
| **Sixth Layer: UV-Absorbent Layer** | |
| Gelatin | 0.54 g/$m^2$ |
| UV-Absorbent (q) | 0.21 g/$m^2$ |
| Solvent (s) | 0.09 cc/$m^2$ |
| **Seventh Layer: Protective Layer** | |
| Gelatin | 1.33 g/$m^2$ |
| Acryl-modified Copolymer of Poly-vinyl Alcohol (Modified Degree: 17%) | 0.17 g/$m^2$ |

Regarding the specific composition of the silver halide emulsion used in each light-sensitive emulsion layer and the combination of the each emulsion and the other additive compounds, refer to the following Table 11.

TABLE 11

| Sample | | 1st Layer | 2nd Layer | 3rd Layer | 4th Layer | 5th Layer | 6th Layer | 7th Layer |
|---|---|---|---|---|---|---|---|---|
| 3-1 | Silver Halide Emulsion | (1) | — | (1) | — | (7) | — | — |
| | Added Compound(s) | — | — | — | — | I-19 ($1.0 \times 10^{-4}$) | — | — |
| | (mol/mol Ag) | — | — | — | — | IV-21 ($6.0 \times 10^{-4}$) | — | — |
| 3-2 | Silver Halide Emulsion | (3) | — | (3) | — | (8) | — | — |
| | Added Compound(s) | — | — | — | — | I-19 ($1.0 \times 10^{-4}$) | — | — |
| | (mol/mol Ag) | — | — | — | — | IV-21 ($6.0 \times 10^{-4}$) | — | — |
| 3-3 | Silver Halide Emulsion | (5) | — | (5) | — | (9) | — | — |
| | Added Compound(s) | — | — | — | — | I-13 ($8.0 \times 10^{-5}$) | — | — |
| | (mol/mol Ag) | — | — | KBr ($3.0 \times 10^{-3}$) | — | IV-12 ($2.0 \times 10^{-4}$) | — | — |
| 3-4 | Silver Halide Emulsion | (5) | — | (5) | — | (9) | — | — |
| | Added Compound(s) | — | — | — | — | I-7 ($8.0 \times 10^{-5}$) | — | — |
| | (mol/mol Ag) | — | — | — | — | IV-9 ($3.0 \times 10^{-4}$) | — | — |
| 3-5 | Silver Halide Emulsion | (5) | — | (5) | — | (9) | — | — |
| | Added Compound(s) | — | — | — | — | I-19 ($1.0 \times 10^{-4}$) | — | — |
| | (mol/mol Ag) | — | — | — | — | IV-21 ($6.0 \times 10^{-4}$) | — | — |
| | | (f) ($3.5 \times 10^{-4}$) | — | (f) ($4.0 \times 10^{-4}$) | — | (d) ($4.0 \times 10^{-4}$) | — | — |

In addition, Sample (3-6) and Sample (3-7) were prepared in the same manner as Sample (3-5), except that only the coated amounts of the 1st layer and the 5th layer were varied in Sample (3-6) and all the coated amounts of the light-sensitive emulsions were varied in Sample (3-7). The coated amount of the silver halide emulsion in each of the light-sensitive emulsion layers in these two kinds of samples is set forth in the following Table 12.

TABLE 12

| | Coated Amount (as Silver) of Silver Halide Emulsion | | | |
|---|---|---|---|---|
| | 1st Layer | 3rd layer | 5th Layer | Total |
| Sample 3-6 | 0.35 g/$m^2$ | 0.13 g/$m^2$ | 0.27 g/$m^2$ | 0.75 g/$m^2$ |
| Sample 3-7 | 0.35 g/$m^2$ | 0.20 g/$m^2$ | 0.30 g/$m^2$ | 0.85 g/$m^2$ |

A gradation exposure for sensitometry was imparted to these samples through each of blue-, green- and red-filters by the use of a sensitometer (FWH-type, manufactured by Fuji Photo Film Co., Ltd.; Color temperature in light source: 3200° K.). In this treatment, the amount of the exposure was regulated so as to be 250 CMS by the exposure of 0.5 second. Afterwards, the thus-exposed samples were subjected to the same experimentation using the Treatments (A) and (B) as in Example 1. The results as to the photographic properties of each sample obtained are set forth in the following Table 13, where the relative sensitivity is defined as a relative value to the standard sensitivity (100) of each light-sensitive layer of each sample as color-developed for 3 minutes and 30 seconds by Treatment (A), and the color forming property is evaluated for each light-sensitive layer of each sample in accordance with the evaluation standard as used in Example 1.

In addition, in order to evaluate the desilvering property, additional experiments were carried out where the bleach-fixation time was shortened to 30 seconds in Treatment (B), in addition to the original Treatment (B) as employed in Example 1.

The following Table 14 shows the results of the desilvering property of the Samples (3-5) (3-6) and (3-7) as obtained in accordance with the above-described experiments.

TABLE 13

| Sample No. | Layer | Treatment (A) Development Time | Dmin | Relative Sensitivity | Color Forming Property | Treatment (B) Development Time | Dmin | Relative Sensitivity | Color Forming Property | Coated Silver Amount |
|---|---|---|---|---|---|---|---|---|---|---|
| 3-1 | B | 3 min 30 sec | 0.08 | 100 | 1.50 | 45 sec | 0.08 | 66 | 0.75 | 0.63 g/m$^2$ |
| | | | | | | 60 sec | 0.08 | 87 | 1.11 | |
| | G | 3 min 30 sec | 0.10 | 100 | 1.50 | 45 sec | 0.10 | 89 | 1.32 | |
| | | | | | | 60 sec | 0.10 | 95 | 1.43 | |
| | R | 3 min 30 sec | 0.12 | 100 | 1.50 | 45 sec | 0.11 | 85 | 1.26 | |
| | | | | | | 60 sec | 0.12 | 93 | 1.38 | |
| 3-2 | B | 3 min 30 sec | 0.08 | 100 | 1.50 | 30 sec | 0.08 | 79 | 1.26 | 0.63 g/m$^2$ |
| | | | | | | 60 sec | 0.09 | 123 | 1.58 | |
| | G | 3 min 30 sec | 0.10 | 100 | 1.50 | 30 sec | 0.10 | 93 | 1.34 | |
| | | | | | | 60 sec | 0.10 | 112 | 1.52 | |
| | R | 3 min 30 sec | 0.11 | 100 | 1.50 | 30 sec | 0.11 | 95 | 1.37 | |
| | | | | | | 60 sec | 0.11 | 112 | 1.62 | |
| 3-3 | B | 3 min 30 sec | 0.08 | 100 | 1.50 | 30 sec | 0.10 | 95 | 1.51 | 0.63 g/m$^2$ |
| | | | | | | 60 sec | 0.14 | 115 | 1.67 | |
| | G | 3 min 30 sec | 0.10 | 100 | 1.50 | 30 sec | 0.09 | 100 | 1.53 | |
| | | | | | | 60 sec | 0.13 | 112 | 1.65 | |
| | R | 3 min 30 sec | 0.12 | 100 | 1.50 | 30 sec | 0.12 | 107 | 1.49 | |
| | | | | | | 60 sec | 0.13 | 123 | 1.72 | |
| 3-4 | B | 3 min 30 sec | 0.08 | 100 | 1.50 | 30 sec | 0.09 | 95 | 1.52 | 0.63 g/m$^2$ |
| | | | | | | 60 sec | 0.14 | 115 | 1.68 | |
| | G | 3 min 30 sec | 0.10 | 100 | 1.50 | 30 sec | 0.10 | 100 | 1.53 | |
| | | | | | | 60 sec | 0.13 | 112 | 1.66 | |
| | R | 3 min 30 sec | 0.11 | 100 | 1.50 | 30 sec | 0.12 | 105 | 1.49 | |
| | | | | | | 60 sec | 0.14 | 120 | 1.74 | |
| 3-5 | B | 3 min 30 sec | 0.07 | 100 | 1.50 | 30 sec | 0.07 | 105 | 1.51 | 0.63 g/m$^2$ |
| | | | | | | 60 sec | 0.07 | 123 | 1.66 | |
| | G | 3 min 30 sec | 0.10 | 100 | 1.50 | 30 sec | 0.09 | 115 | 1.53 | |
| | | | | | | 60 sec | 0.09 | 123 | 1.65 | |
| | R | 3 min 30 sec | 0.10 | 100 | 1.50 | 30 sec | 0.10 | 115 | 1.60 | |
| | | | | | | 60 sec | 0.10 | 129 | 1.78 | |
| 3-6 | B | 3 min 30 sec | 0.07 | 100 | 1.50 | 30 sec | 0.07 | 102 | 1.51 | 0.75 g/m$^2$ |
| | | | | | | 60 sec | 0.07 | 117 | 1.60 | |
| | G | 3 min 30 sec | 0.10 | 100 | 1.50 | 30 sec | 0.10 | 100 | 1.45 | |
| | | | | | | 60 sec | 0.10 | 115 | 1.66 | |
| | R | 3 min 30 sec | 0.11 | 100 | 1.50 | 30 sec | 0.11 | 115 | 1.60 | |
| | | | | | | 60 sec | 0.11 | 129 | 1.78 | |
| 3-7 | B | 3 min 30 sec | 0.08 | 100 | 1.50 | 30 sec | 0.08 | 76 | 1.22 | 0.85 g/m$^2$ |
| | | | | | | 60 sec | 0.09 | 107 | 1.58 | |
| | G | 3 min 30 sec | 0.10 | 100 | 1.50 | 30 sec | 0.09 | 79 | 1.45 | |
| | | | | | | 60 sec | 0.10 | 105 | 1.60 | |
| | R | 3 min 30 sec | 0.11 | 100 | 1.50 | 30 sec | 0.11 | 83 | 1.50 | |
| | | | | | | 60 sec | 0.11 | 107 | 1.71 | |

TABLE 14

| Layer | Bleaching-Fixation Time (sec) | Desilvering Property Sample 3-5 | Sample 3-6 | Sample 3-7 |
|---|---|---|---|---|
| B | 45 | 4 | 3 | 2 |
| G | 45 | 4 | 4 | 3 |
| R | 45 | 4 | 4 | 4 |

As is apparent from Tables 13 and 14, B, G, and R represent the blue-, green- and red-sensitive emulsion layers in each sample.

As is apparent from the results shown in Table 13, the multi-layer color photographic materials can effectively be processed by rapid treatment with the color developer of the present invention, which does not contain any benzyl alcohol, whereupon the generation of fog is less, the color forming property is good and the spectral sensitivity is sufficient. Even though the compounds I-17 to I-20 according to the present invention are used, the same good results can be obtained.

In addition, as is apparent from the comparison between the desilvering property in the samples (3-5), (3-6) and (3-7), the effect of the present invention is especially remarkable where the coated silver amount of 0.78 g/m$^2$ or less.

The effects of the present invention are summarized as follows. The most characteristic feature of the present invention is the incorporation of the specific spectral sensitizing dyes represented by general formula (I), (II) or (III) into a high silver chloride emulsion, whereby the photographic materials containing this type of emulsion can rapidly be developed with a color developer which substantially excludes benzyl alcohol for a short period of time of about 2 minutes and 30 seconds or less, and the photographic properties of the thus-processes photographic materials are excellent in that the color forming property is good, the spectral sensitivity is sufficient and the generation of fog (Dmin) is low.

In addition, the desilvering disturbance which is specific to the high chloride content silver halide emulsions and the spectral sensitizing dyes which are suitable to the former can effectively be eliminated by the rapid treatment with a processing solution having a bleaching ability and having a pH of 6;.5 or less.

In the practice of the present invention, the incorporation of benzyl alcohol into the color developer can substantially be avoided, whereby the amount of environmental pollution can noticeably be reduced and the amounts necessary for the preparation of the photographic processing solutions can further be reduced. In addition, the conversion of the cyan dye into the leuco form can be inhibited, whereby a decrease in the color density of the formed color image can be eliminated. Further, the color developer solutions are excellent in preservation stability, without the generation of any tar even after storage for a long period of time.

While the invention has been described in detail and with reference to specific embodiments thereof, it will be apparent to one skilled in the art that various changes and modifications can be made therein without departing from the spirit and scope thereof.

What is claimed is:

1. A method for forming color images comprising imagewise exposing a silver halide color photographic material, processing with a color developer, and then successively processing with a solution having a bleaching ability and having a pH of about 6.5 or less for a period of time of about 75 seconds or less, wherein said photographic material comprises at least one light-sensitive layer on a support, said light-sensitive layer containing at least one coupler capable of forming a dye by a coupling reaction with an oxidation product of an aromatic primary amine color developing agent and a silver halide emulsion which substantially excludes silver iodide but contains silver chloride in an amount of about 80 mol% or more and which has been spectrally sensitized with a sensitizing dye represented by formula (I), (II), or (III):

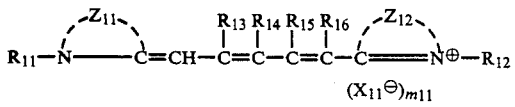

(I)

wherein $Z_{11}$ represents an atomic group necessary to form a benzoxazole nucleus, a naphthoxazole nucleus, a benzothiazole nucleus, a naphthothiazole nucleus, a dihydronaphthothiazole nucleus, a benzoselenazole nucleus, a naphthoselenazole nucleus or a dihydronaphthoselenazole nucleus;

$Z_{12}$ represents an atomic group necessary to form a benzothiazole nucleus, a naphthothiazole nucleus, a dihydronaphthothiazole nucleus, a benzoselenazole nucleus, a naphthoselenazole nucleus or a dihydronaphthoselenazole nucleus;

the nitrogen-containing heterocyclic nuclei represented by $Z_{11}$ and $Z_{12}$ are unsubstituted or substituted by one or more substitutents;

$R_{11}$ and $R_{12}$ are the same or different and each represents a substituted or unsubstituted alkyl group or alkenyl group having 10 or less carbon atoms and which may optionally be substituted;

$R_{13}$ and $R_{15}$ both are hydrogen atoms, or $R_{13}$ and $R_{15}$ as linked together to form a 5- or 6-membered ring;

$R_{14}$ represents a hydrogen atom, when $R_{13}$ is linked with $R_{15}$ to form a 5- or 6-membered ring; or when $R_{13}$ and $R_{15}$ both are hydrogen atom, $R_{14}$ represents an alkyl group having 4 or less carbon atoms or a phenylalkyl group having 10 or less carbon atoms;

$R_{16}$ represents a hydrogen atom, or is linked with $R_{12}$ to form a 5- or 6-membered carbon-ring;

$X_{11}^{\ominus}$ represents an acid anion residual group;

$m_{11}$ represents 0 or 1; and when the sensitizing dye represented by formula (I) forms an internal salt, $m_{11}$ is 0;

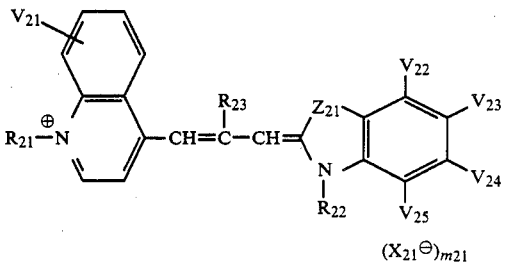

(II)

wherein $Z_{21}$ represents a sulfur atom or a selenium atom;

$R_{21}$ and $R_{22}$ each has the same definition as $R_{11}$ or $R_{12}$ in formula (I), with the proviso that at least one of $R_{21}$ and $R_{22}$ is a substituent containing a sulfo group or a carboxyl group;

$R_{23}$ represents a hydrogen atom or a lower alkyl group having 4 or less carbon atoms;

$V_{21}$ represents a hydrogen atom, an alkyl or alkoxy group having 6 or less carbon atoms, a fluorine atom, a chlorine atom, or a hydroxyl group;

$V_{22}$ and $V_{25}$ each represents a hydrogen atom;

$V_{23}$ represents a hydrogen atom, a lower alkyl group, a lower alkoxy group, or a hydroxyl group;

$V_{24}$ represents a hydrogen atom, a lower alkyl group, a lower alkoxy group, a chlorine atom, a lower alkoxycarbonyl group, a substituted or unsubstituted phenyl group, or a hydroxyl group; or $V_{22}$ and $V_{23}$, $V_{23}$ and $V_{24}$, and $V_{24}$ and $V_{25}$ each is linked together to form a substituted or unsubstituted condensed benzene ring;

$X_{21}^{\ominus}$ represents an acid anion residual group;

$m_{21}$ represents 0 to 1; and when the sensitizing dye represented by formula (II) forms an internal salt, $m_{21}$ is 0;

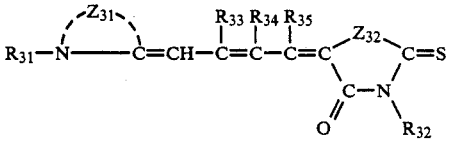

(III)

wherein $Z_{31}$ has the same definition as $Z_{12}$ in formula (I), or represents an atomic group capable of forming a naphthoxazole nucleus, and the nitrogen-containing heterocyclic nuclei represented by $Z_{31}$ is unsubstituted or substituted by one or more substitutents;

$Z_{32}$ represents a sulfur atom, a selenium atom or

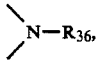

wherein $R_{36}$ represents a hydrogen atom, a pyridyl group, a phenyl group, a substituted phenyl group or a substituted or unsubstituted aliphatic hydrocarbon group which contains or excludes an oxygen atom, a sulfur atom or a nitrogen atom in the carbon chain, the total number of carbon atoms in said aliphatic hydrocarbon group being 8 or less;

$R_{31}$ has the same definition as $R_{11}$ or $R_{12}$ in formula (I);

$R_{32}$ has the same definition as $R_{11}$ or $R_{12}$ in formula (I), or represents a hydrogen atom, a furfuryl group, or a substituted or unsubstituted mono cyclic aryl group;

$R_{33}$ and $R_{35}$ each represents a hydrogen atom, or $R_{33}$ and $R_{35}$ as linked together to form a 5- or 6-membered ring;

$R_{34}$ has the same definition as $R_{14}$ in formula (I); with the proviso that at least one of $R_{31}$ and $r_{32}$ does not contain a sulfo group and the other is a group containing a sulfo group or a carboxyl group.

2. A method for forming color images as in claim 1, wherein the amount of the silver halide coated on said support is about 0.78 g/m$^2$ or less as silver.

3. A method for forming color images as in claim 1, wherein the color developer contains bromide ion in an amount of about 0.002 mol/liter or less.

4. A method for forming color images as in claim 1, wherein said processing with a color developer comprises a period of time of about 2 minutes and 30 seconds or less, and said color developer substantially excludes benzyl alcohol.

5. A method for forming color images as in claim 1, wherein said solution having a bleaching ability is a bleaching-fixation solution having a pH of about 6.5 or less.

6. A method for forming color images as in claim 1, wherein said silver halide emulsion substantially excludes silver iodide but contains silver chloride in an amount of 90 mol% or more.

7. A method for forming color images as in claim 1, wherein said sensitizing dye represented by general formula (I), (II) or (III) is present in an amount of from about $4\times10^{-6}$ to about $8\times10^{-3}$ mol per mol of silver halide in said silver halide emulsion.

8. A method for forming color images as in claim 1, wherein said silver halide emulsion further contains at least one compound represented by formula (IV):

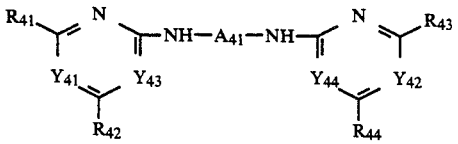

(IV)

wherein $Y_{41}$, $Y_{42}$, $Y_{43}$ and $Y_{44}$ are the same or different, and each represents =CH— or =N—, with proviso that at least one of Y41 and $Y_{43}$ and at least one of $Y_{42}$ and $Y_{44}$ represent =N—;

$R_{41}$, $R_{42}$, $R_{43}$ and $R_{44}$ are the same or different, and each represents a hydrogen atom, a hydroxyl group, a lower alkoxy group, an aryloxy group, a halogen atom, a heterocyclic group, a heterocyclicthio group, an alkylthio group, an arylthio group, a mercapto group, an amino group, an alkylamino group, an arylamino group, a heterocyclic amino group, or an aryl group, which are substituted or unsubstituted;

$A_{41}$ represents a group comprising at least one substituted or unsubstituted arylene group.

9. A method for forming color images as in claim 8, wherein said compound is present in an amount of from about 0.2 to about 200 times, by molar ratio, the amount of said sensitizing dye.

10. A method for forming color images as in claim 1, wherein said silver halide emulsion is spectrally sensitized with a sensitizing dye represented by formula (I), (II) or (III) in the presence of a water-soluble bromide present in an amount of 1 mol% or less per mol of said silver halide.

11. A method for forming color images as in claim 8, wherein said silver halide emulsion is spectrally-sensitized with a sensitizing dye represented by formula (I), (II) or (III) in the presence of a water-soluble bromide present in an amount of about 1 mol% or less per mol of the silver halide.

12. A method for forming color images as in claim 1, wherein said processing with a solution having a bleaching ability occurs for a period of time of 60 seconds or less.

13. A silver halide color photographic material comprising at least one light-sensitive layer on a reflective support, said light-sensitive layer containing at least one coupler capable of forming a dye by the coupling reaction with an oxidation product of an aromatic primary amine color developing agent and a silver halide emulsion which substantially excludes silver iodide but contains silver chloride in an amount of about 80 mol% or more and which has been spectrally-sensitized with a sensitizing dye represented by formula (I), (II) or (III):

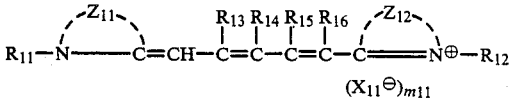

(I)

wherein $Z_{11}$ represents an atomic group necessary to form a benzoxazole nucleus, a naphthoxazole nucleus, a benzothiazole nucleus, a naphthothiazole nucleus, a dihydronaphthohothiazole nucleus, a benzoselenazole nucleus, a naphthoselenazole nucleus or a dihydronaphthoselenazole nucleus;

$Z_{12}$ represents an atomic group necessary to form a benzothiazole nucleus, a naphthothiazole nucleus, a dihydronaphthothiazole nucleus, a benzoselenazole nucleus, a naphthoselenazole nucleus or a dihydronaphthoselenazole nucleus;

the nitrogen-containing heterocyclic nuclei represented by $Z_{11}$ and $Z_{12}$ may optionally have one or more substituents;

$R_{11}$ and $R_{12}$ may be the same or different and each represents an alkyl group or an alkenyl group having 10 or less carbon atoms and which may optionally be substituted;

$R_{13}$ and $R_{15}$ both are hydrogen atoms, or $R_{13}$ and $R_{15}$ may be linked together to form a 5- or 6-membered ring;

$R_{14}$ represents a hydrogen atom, when $R_{13}$ is linked with $R_{15}$ to form a 5- or 6-membered ring; or when $R_{13}$ and $R_{15}$ both are hydrogen atom, $R_{14}$ represents an alkyl group having 4 or less carbon atoms or a phenylalkyl group having 10 or less carbon atoms;

$R_{16}$ represents a hydrogen atom, or may be linked with $R_{12}$ to form a 5- or 6-membered carbon-ring;

$X_{11}^{\ominus}$ represents an acid anion residue;

$m_{11}$ represents 0 or 1; and when the sensitizing dye represented by formula (I) forms an internal salt, $m_{11}$ is 0;

(II)

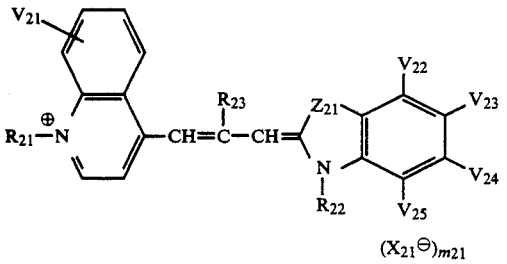

wherein $Z_{21}$ represents a sulfur atom or a selenium atom;

$R_{21}$ and $R_{22}$ each has the same definition as $R_{11}$ or $R_{12}$ in formula (I), with the proviso that at least one of $R_{21}$ and $R_{22}$ must be a substituent containing a sulfo group or a carboxyl group;

$R_{23}$ represents a hydrogen atom or a lower alkyl group having 4 or less carbon atoms;

$V_{21}$ represents a hydrogen atom, an alkyl group or an alkoxy group having 6 or less carbon atoms, a fluorine atom, a chlorine atom or a hydroxyl group;

$V_{22}$ and $V_{25}$ each represents a hydrogen atom;

$V_{23}$ represents a hydrogen atom, a lower alkyl group, a lower alkoxy group or a hydroxyl group;

$V_{24}$ represents a hydrogen atom, a lower alkyl group, a lower alkoxy group, a chlorine atom, a lower alkoxycarbonyl group, an optionally substituted phenyl group or a hydroxyl group;

$V_{22}$ and $V_{23}$, $V_{23}$ and $V_{24}$, and $V_{24}$ and $V_{25}$ each may optionally be linked together to form a condensed benzene ring, which can further be substituted;

$X_{21}^{\ominus}$ represents an acid anion residue;

$m_{21}$ represents 0 or 1; and when the sensitizing dye represented by formula (II) forms an internal salt, $m_{21}$ is 0;

(III)

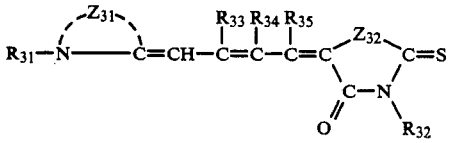

wherein $Z_{31}$ has the same definition as $Z_{12}$ in formula (I), or represents an atomic group capable of forming a naphthoxazole nucleus, and the nitrogen-containing heterocyclic nuclei represented by $Z_{31}$ can have one or more substituents; $Z_{32}$ represents a sulfur atom, a selenium atom or

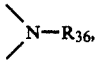

wherein $R_{36}$ represents a hydrogen atom, a pyridyl group, a phenyl group, a substituted phenyl group or an aliphatic hydrocarbon group which may optionally contain an oxygen atom, a sulfur atom or a nitrogen atom in the carbon chain and which may optionally be substituted, the total number of carbon atoms in said aliphatic hydrocarbon group being 8 or less;

$R_{31}$ has the same definition as $R_{11}$ or $R_{12}$ in formula (I);

$R_{32}$ has the same definition as $R_{11}$ or $R_{12}$ in formula (I), or represents a hydrogen atom, a furfuryl group or an optionally substituted mono-cyclic aryl group;

$R_{33}$ and $R_{35}$ each represents a hydrogen atom, or $R_{33}$ and $R_{35}$ may be linked together to form a 5- or 6-membered ring;

$R_{34}$ has the same definition as $R_{14}$ in formula (I); with the proviso that at least one of $R_{31}$ and $r_{32}$ does not contain a sulfo group and the other is a group containing a sulfo group or a carboxyl group.

14. A silver halide color photographic material as in claim 13, wherein said silver halide emulsion further contains at least one compound represented by general formula (IV):

(IV)

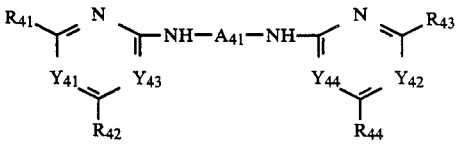

wherein $Y_{41}$, $Y_{42}$, $Y_{43}$ and $Y_{44}$ may be the same or different, and each represents =CH— or =N—, with proviso that at least one of $Y_{41}$ and $Y_{43}$ and at least one of $Y_{42}$ and $Y_{44}$ represent =N—;

$R_{41}$, $R_{42}$, $R_{43}$ and $R_{44}$ may be the same or different, and each represents a hydrogen atom, a hydroxyl group, a lower alkoxy group, an aryloxy group, a halogen atom, a heterocyclic group, a heterocyclicthio group, an alkylthio group, an arthylthio group, a mercapto group, an amino group, an alkylamino group, an arylamino group, a heterocyclic amino group, or an aryl group, which may optionally be substituted; and $A_{41}$ represents a group comprising at least one arylene group, which may be substituted.

15. A silver halide color photographic material as in claim 13, wherein said silver halide emulsion is spectrally-sensitized with a sensitizing dye represented by formula (I), (II) or (III) in the presence of a water-soluble bromide present in an amount of about 1 mol% or less per mol of the silver halide.

16. A silver halide color photographic material as claimed in claim 13, wherein said sensitizing dye is present in an amount of from about $4\times10^{-6}$ to about $8\times10^{-3}$ mol per mol of silver halide in said silver halide emulsion.

17. A silver halide color photographic material as claimed in claim 14, wherein said compound is present in an amount of from about 0.2 to about 200 times, by molar ratio, the amount of said sensitizing dye.

18. A silver halide color photographic material as claimed in claim 14, wherein said silver halide emulsion is spectrally-sensitized with a sensitizing dye represented by formula (I), (II) or (III) in the presence of a water-soluble bromide present in an amount of about 1 mol% or less per mol of the silver halide.

19. A silver halide color photographic material as claimed in claim 13, wherein said silver chloride in present in an amount of 90 mol% or more.

20. A silver halide color photographic material as claimed in claim 13, wherein said material is processed with a color developer for a period of time of about 2 minutes and 30 seconds or less, and then successively processed by a solution having a bleaching ability and having a pH of 6.0 or less for a period of time of 60 seconds or less.

21. A method for forming color images as in claim 8, wherein at least one of $R_{41}$, $R_{42}$, $R_{43}$, $R_{44}$, and $A_{41}$ has a sulfs group.

22. A method for forming color images as in claim 8, said compound represented by formula (IV) is a stilbene derivative.

23. A method for forming color images as in claim 8, wherein the amount of said compound represented by formula (IV) is from 1 from 30 times the amount of said sensitizing dye represented by formula (I), (II) or (III).

24. A method for forming color images as in claim 11, wherein said silver halide emulsion is spectrally-sensitized with a sensitizing dye represented by formula (I), (II), or (III) in the presence of a water-soluble bromide present in an amount of 0.5 mol% or less per mol of the silver halide.

25. A method for forming color images as in claim 1, wherein said silver halide emulsion has an average grain size of from 0.2 to 1.3 μm, and said sensitizing dye represented by formula (I), (II), or (III) is present in an amount of from $5\times10^{-5}$ to $2\times10^{-3}$ mol per mol of silver halide in said silver halide emulsion.

26. A method for forming color images as in claim 3, wherein the color developer contains bromide ion in an amount of 0.0007 mol/liter or less.

27. A method for forming color images as in claim 6, wherein said silver halide emulsion is consisting of silver chlorobromide containing silver chloride in amount of 95 mol% or more, or silver chloride.

28. A method for forming color images as in claim 1, wherein said silver halide emulsion is monodispersed.

29. A method for forming color images as in claim 1, wherein the degree of monodispersibility of said silver halide emulsion is about 0.2 or less, measured by the ratio ($s/\bar{d}$) or the statistical standard deviation (s) to the mean grain size ($\bar{d}$).

30. A method for forming color images as in claim 29, wherein the degree of monodispersibility of said silver halide emulsion is 0.15 or less, measured by the ratio ($s/\bar{d}$) of the statistical standard deviation (s) to the mean grain size ($\bar{d}$).

31. A method for forming color images as in claim 1, wherein said silver halide emulsion is a mixture of monodispersed silver halide emulsions.

32. A method for forming color images as in claim 1, wherein said silver halide emulsion has a cubic crystal form.

33. A method for forming color images as in claim 1, wherein said silver halide emulsion contains a pyrazolotriazole type color coupler.

* * * * *